US010413087B2

(12) United States Patent
Smeltz

(10) Patent No.: US 10,413,087 B2
(45) Date of Patent: Sep. 17, 2019

(54) CRIB

(71) Applicant: PediaLift LLC, Mansfield, OH (US)

(72) Inventor: Clayton Prescan Smeltz, Mansfield, OH (US)

(73) Assignee: PEDIALIFT LLC, Mansfield, OH (US)

( * ) Notice: Subject to any disclaimer, the term of this patent is extended or adjusted under 35 U.S.C. 154(b) by 527 days.

(21) Appl. No.: 15/241,921

(22) Filed: Aug. 19, 2016

(65) Prior Publication Data

US 2018/0049561 A1 Feb. 22, 2018

(51) Int. Cl.

| | |
|---|---|
| ***A47D 7/01*** | (2006.01) |
| ***A47D 7/03*** | (2006.01) |
| ***A47C 21/08*** | (2006.01) |
| ***A47D 15/00*** | (2006.01) |
| ***A47C 19/04*** | (2006.01) |

(52) U.S. Cl.

CPC ..... *A47D 7/01* (2013.01); *A47C 19/045* (2013.01); *A47C 21/08* (2013.01); *A47D 7/03* (2013.01); *A47D 15/008* (2013.01)

(58) Field of Classification Search

CPC ... A47D 7/00; A47D 7/01; A47D 7/02; A47D 7/03; A47D 7/04; A47D 7/005; A47D 9/00; A47D 15/008; A47D 21/08; A47C 19/045

See application file for complete search history.

(56) References Cited

U.S. PATENT DOCUMENTS

| | | | | |
|---|---|---|---|---|
| 1,391,566 | A | 9/1921 | Musselman | |
| 2,109,267 | A | 2/1938 | Grosser | |
| 2,442,048 | A | 5/1948 | Kroll | |
| 2,555,160 | A * | 5/1951 | Schwarz | A47D 7/03 248/422 |
| 2,662,231 | A | 12/1953 | King | |
| 2,698,442 | A * | 1/1955 | Travis | A61G 7/005 108/49 |
| 2,889,560 | A * | 6/1959 | Carman | A47D 7/02 5/100 |
| 3,345,653 | A | 10/1967 | Mixon | |
| 3,403,412 | A | 10/1968 | Gottfried | |
| 3,670,344 | A * | 6/1972 | Boudreau | A47B 91/02 248/188.2 |
| 3,797,053 | A | 3/1974 | Mamo | |

(Continued)

*Primary Examiner* — Robert G Santos
*Assistant Examiner* — David R Hare
(74) *Attorney, Agent, or Firm* — Wegman Hessler

(57) ABSTRACT

Disclosed is a crib that elevates a carriage from the lowered position to height that is user defined. The lifting motion is operated by holding buttons on controls on the unit or a wireless remote; releasing the button stops the motion. While in the elevated position, a sliding door assembly provides access to the inside of the carriage while leaving the underside of the carriage free of obstruction as to permit wheelchair using caretakers to freely pull underneath the elevated carriage. The carriage of the crib includes a mattress support, rear wall, right wall, left wall, and a front wall having a left and right sliding door. A telescoping lifting column is fastened to each of the right wall and left wall. The lifting columns have an electric linear actuator that perform the lifting and lowering operations of the carriage. The lifting columns extend downward and are fastened to feet.

20 Claims, 26 Drawing Sheets

(56) References Cited

U.S. PATENT DOCUMENTS 3,894,304 A * 7/1975 Burbidge ..... A47D 9/04 5/105
3,896,513 A * 7/1975 Boucher ..... A47D 7/002 5/100
3,921,233 A * 11/1975 Mann ..... A47D 7/02 5/100
4,715,075 A * 12/1987 Shamie ..... A47D 7/01 5/93.1
4,811,436 A 3/1989 Schwartz
4,894,581 A 1/1990 Roberts
4,937,902 A 7/1990 Ceike Shapiro
5,093,945 A * 3/1992 Schoonover ..... A47D 7/03 5/100
5,214,808 A * 6/1993 Schoonover ..... A47D 7/02 5/100
5,535,457 A 7/1996 Welsh, Jr. et al.
5,666,765 A * 9/1997 Sarner ..... A47B 37/00 235/51
5,742,959 A 4/1998 Froelich
5,884,348 A * 3/1999 Onishi ..... A47D 7/02 5/100
5,926,870 A 7/1999 Branca-Barnes
6,546,880 B2 * 4/2003 Agee ..... A47B 9/12 108/147
6,618,877 B2 9/2003 Stephen
6,938,286 B1 * 9/2005 Smith ..... A47D 7/02 292/202
7,017,204 B1 3/2006 Fertil
7,797,775 B2 9/2010 Miller
7,908,981 B2 * 3/2011 Agee ..... A47B 9/04 108/147
D677,929 S 3/2013 Draheim
8,397,321 B1 * 3/2013 Smith ..... A47D 7/01 5/100
8,453,278 B2 * 6/2013 Aiken ..... A47D 7/01 5/100
8,566,979 B1 * 10/2013 Kayser ..... A47D 7/00 5/100
8,646,126 B2 2/2014 Carta
8,745,780 B2 * 6/2014 Su ..... A47D 7/04 312/301
10,039,389 B2 * 8/2018 Yang ..... A47D 9/02
2003/0126680 A1 * 7/2003 Stephen ..... A47D 7/007 5/93.1
2009/0144899 A1 6/2009 Miller
2011/0203049 A1 * 8/2011 Carta ..... A47D 7/03 5/93.1

* cited by examiner

CRIB

FIELD OF THE INVENTION

The present invention relates to cribs for children.

BACKGROUND OF THE INVENTION

The reference to any prior art in this specification is not, and should not be taken as an acknowledgement or any form of suggestion that the prior art forms part of the common general knowledge.

A crib, commonly referred to as a cot, infant bed, cradle, or stock, is a small bed specifically for children, generally up to 3 years old. Cribs are designed to restrict the child to the bed. Side panels form an enclosure that is too high for the child to climb. While several attempts have been made to design a crib to accommodate the needs of wheelchair using caretakers, the use has remained difficult due to various shortcomings in the designs.

BRIEF SUMMARY OF THE INVENTION

According to one aspect of the invention, a crib includes a carriage and a base having a two column lifting system. The carriage is comprised of a rear wall, a left wall, a right wall, and a front wall extending from a mattress support, thereby forming a rigid box structure having a sleeping area for a child. The two column lifting system has a left lifting column extending from a left foot and a right column extending from a right foot. The left lifting column and the right lifting column are telescoping. The left lifting column is fastened to the left wall and the right lifting column is fastened to the right wall. The left lifting column has a linear actuator and the right lifting column has a linear actuator.

In another aspect of the invention, a width between the left lifting column and the right lifting column is wider than a wheelchair, and a width between the left foot and the right foot is wider than a wheelchair.

In another aspect of the invention, the two column lifting system is user controlled and configured to synchronize movement of the left lifting column and the right lifting column, thereby permitting a user to raise and lower the carriage to a height desired by the user.

In another aspect of the invention, the front wall has a sliding door that permits the user to access the sleeping area of the carriage.

In another aspect of the invention, the two column lifting system permits a user to raise the carriage to a desired elevated position to access the sleeping area of the carriage, and lower the carriage to a lowered position when the user is not accessing the sleeping area. The left lifting column is fastened to the left wall at about a horizontal center of the left wall and the right lifting column is fastened to the right wall at about a horizontal center of the right wall.

In another aspect of the invention, the user can access the sleeping area of the carriage in the elevated position to attend to and/or transfer a child in the crib.

In another aspect of the invention, the two column lifting system allows the user, when seated in a wheelchair, to roll the wheelchair between the left foot and the right foot and into an underneath portion of the crib without encountering an obstruction, when the sliding door is in an open position and the carriage is in an elevated position, thereby permitting the user to have maximum reach range into the sleeping area of the crib. A bottom of the carriage is higher than the users lap when the user is seated in the wheelchair and the carriage is in the elevated position.

In another aspect of the invention, the underneath portion of the crib has a depth, a width, and a height. A depth of the underneath portion extends from about a front face of a bar to about a front of the left foot or about a front of the right foot. A width of the underneath portion extends from about an inner surface of the left lift column to about an inner surface of the right lift column. A height of the underneath portion extends from about an underside of the carriage to about a bottom of a leveling glide. The leveling glide can be one of a left front leveling glide, a left rear leveling glide, a right front leveling glide, or a right rear leveling glide.

In another aspect of the invention, the front wall has a upper door slide and a lower door slide, the sliding door is slidingly attached to the upper door slide and the lower door slide, the upper door slide and the lower door slide are rigid, and the upper door slide and the lower door slide are fastened to the right wall and the left wall. A rigidity of the carriage remains unchanged when the sliding door is in an open position or a closed position.

In another aspect of the invention, the upper door slide has a steel header, thereby helping to maintain the rigidity and a shape of the carriage.

In another aspect of the invention, the sliding door includes a left sliding door and a right sliding door. The right sliding door and the left sliding door meet at about a horizontal center of the front wall, when the right sliding door and the left sliding door are in a closed position, and slide outward away from a horizontal center of the front wall when transitioning from a closed position to the open position.

In another aspect of the invention, a latch for the left sliding door and the right sliding door of the front wall is located at about the horizontal center of the front wall. The latch is a locking latch.

In another aspect of the invention, the left sliding door, the right sliding door, and the latch are all located (co-located) and at the horizontal center of the front wall. This co-location permits a user to perform the following actions with a single hand while sitting in a wheelchair and without the use of fine motor skills: unlocking and relocking the latch and opening and closing the left sliding door and the right sliding door.

In another aspect of the invention, the latch is comprised of a primary latch and a secondary latch. At least one of the primary latch or secondary latch automatically locks, when the left sliding door and/or the right sliding door are placed in the closed position.

In another aspect of the invention, the upper door slide also includes an upper door retaining channel and the lower door slide also includes a lower door retaining channel. The upper door retaining channel retains an upper portion of the left and right sliding doors, and the lower door retaining channel retains a lower portion of the left and right sliding doors, when a roller bearing slide of the left and right sliding doors fails and/or falls off track. This prevents the left and right sliding doors from dislodging from the front wall due to a failure of the roller bearing slide.

In another aspect of the invention, the mattress support also includes a mattress foundation located on top of a mattress frame. The mattress frame is ferrous. A plurality of magnets are fastened to the perimeter of the mattress foundation. The mattress foundation is magnetically selectively attachable to and detachable from the mattress frame. The mattress foundation magnetically detaches from the mattress frame, when an upward force exceeding a predetermined value is applied to an underside of the mattress foundation. In one exemplary embodiment, the predetermined value is about 30 lbf.

In another aspect of the invention, an upper section of the left lifting column is entrapped against the left wall by a left side column support, and an upper section of the right lifting column is entrapped against the right wall by a right side column support.

In another aspect of the invention, a rigidity of the carriage and an entrapment of the upper section of the left lifting column and the upper section of the right lifting column evenly distribute a lifting force used to elevate the carriage through the carriage.

In another aspect of the invention, the crib is also includes a controller configured to monitor the linear actuators for a collision with an obstruction while moving the carriage between an elevated position and a lowered position, and respond upon a detection of the collision.

In another aspect of the invention, the controller responds when the collision is detected by momentarily changing a direction of travel of the carriage and then stopping the travel of the carriage.

In another aspect of the invention, the carriage is raised or lower, when a button connected to the controller is pressed and held by the user. The raising or lowering of the carriage stops upon a release of the button by the user.

In another aspect of the invention, the button can part of a control panel mounted on the crib and hardwired to the controller, or the button can be on a wireless remote that is wirelessly connected to the controller.

In another aspect of the invention, a horizontal bar attached to the right foot and the left foot maintain a horizontal rigidity of the crib by reducing a rotation of the right foot and the left foot, when the carriage is in an elevated position and a lateral horizontal force is applied to the crib.

In another aspect of the invention, a panel or other components of the crib can be constructed of a solid surface plastic polymer.

Advantages of the present invention will become more apparent to those skilled in the art from the following description of the embodiments of the invention which have been shown and described by way of illustration. As will be realized, the invention is capable of other and different embodiments, and its details are capable of modification in various respects.

BRIEF DESCRIPTION OF SEVERAL VIEWS OF THE DRAWINGS

The embodiments disclosed herein will become more fully apparent from the following description and appended claims, taken in conjunction with the accompanying drawings. These drawings depict only typical embodiments, which will be described with additional specificity and detail through use of the accompanying drawings in which:

The same reference numbers are generally used to refer to corresponding or similar features in the different embodiments. Accordingly, the drawing(s) and description are to be regarded as illustrative in nature and not as restrictive.

DETAILED DESCRIPTION OF THE PREFERRED EMBODIMENT

Figure 1A:
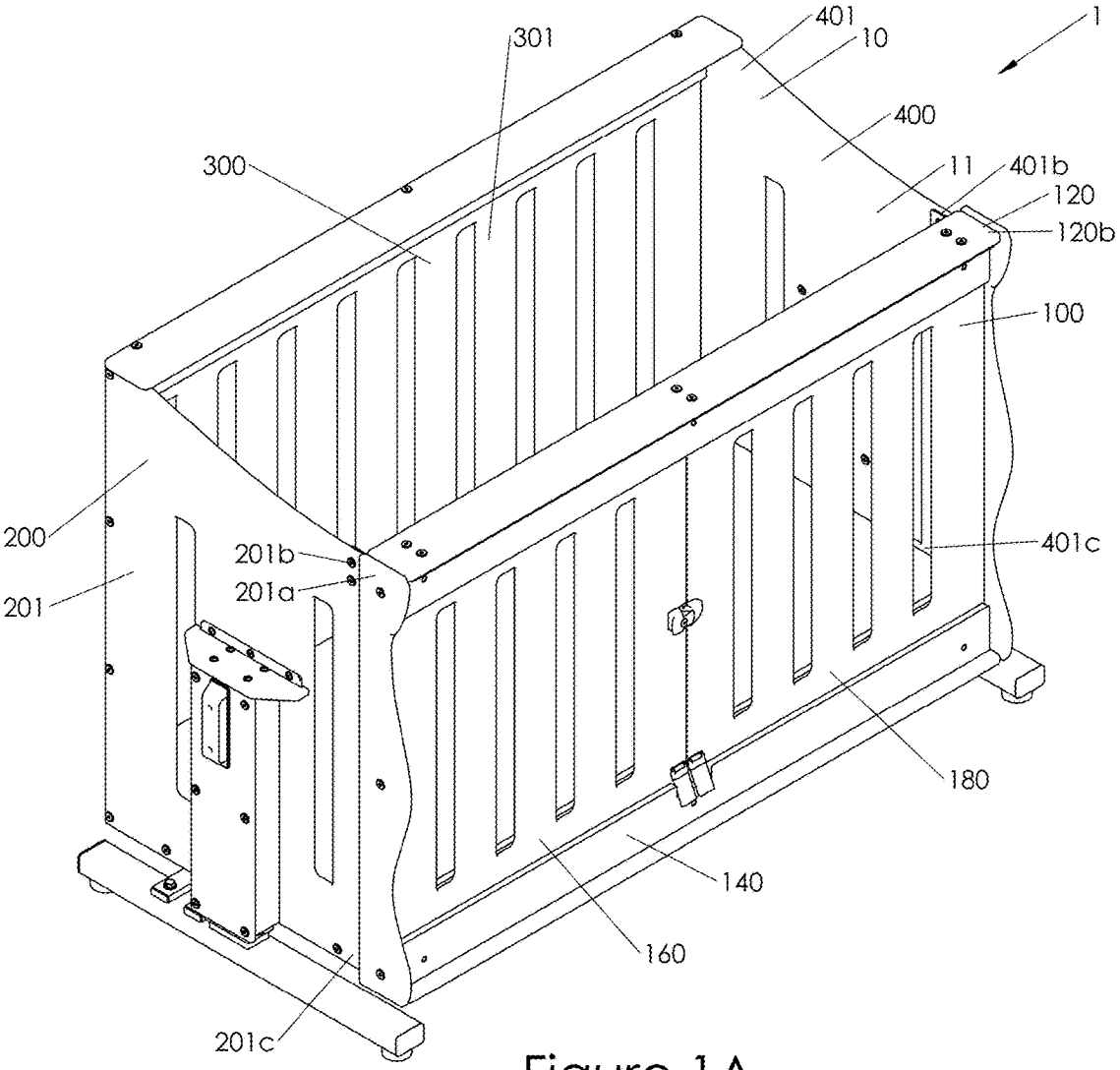
FIG. 1A is a perspective view of a crib in accordance with an exemplary embodiment of the invention.
Figure 1B:
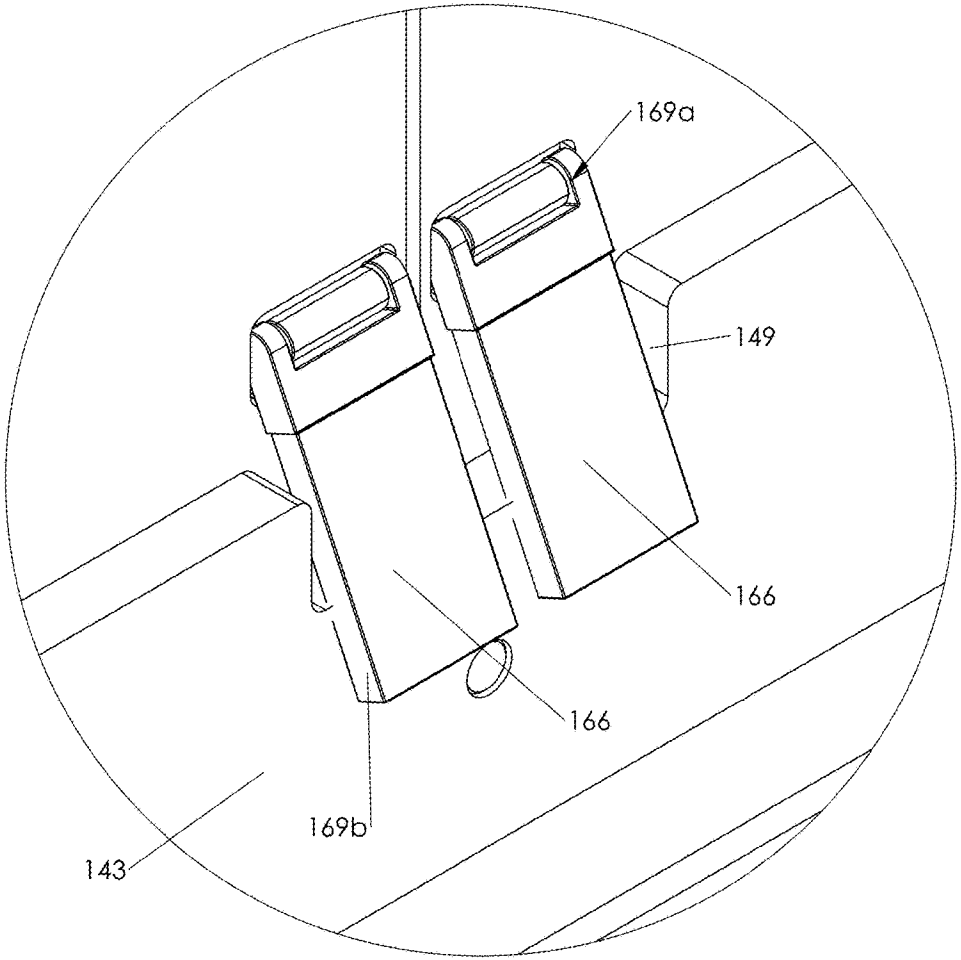
FIG. 1B is a zoomed view of a secondary latch in the locked position in accordance with an exemplary embodiment of the invention.

Approximating language, as used herein throughout the specification and claims, may be applied to modify any quantitative representation that could permissibly vary without resulting in a change in the basic function to which it is related. Accordingly, a value modified by a term or terms, such as "about", is not limited to the precise value specified. In at least some instances, the approximating language may correspond to the precision of an instrument for measuring the value. Range limitations may be combined and/or interchanged, and such ranges are identified and include all the sub-ranges stated herein unless context or language indicates otherwise. Other than in the operating examples or where otherwise indicated, all numbers or expressions referring to quantities of ingredients, reaction conditions and the like, used in the specification and the claims, are to be understood as modified in all instances by the term "about".

As used herein, the terms "comprises", "comprising", "includes", "including", "has", "having", or any other variation thereof, are intended to cover a non-exclusive inclusion. For example, a process, method, article or apparatus that comprises a list of elements is not necessarily limited to only those elements, but may include other elements not expressly listed or inherent to such process, method, article, or apparatus.

The singular forms "a", "an", and "the" include plural referents unless the context clearly dictates otherwise.

The present invention is a specialty crib 1 that is styled to look like a standard, household crib but can transform into an accessible up-lift crib. It is designed for caretakers who have disabilities or conditions that keep them from safely bending over and reaching into a standard crib. The invention was created by a wheelchair using parent who was also an engineer. It was designed to assist parents who are wheelchair users and have a low seated position (relative to the front wall of crib) and often the inability to stabilize themselves when both of their hands are occupied, as is the case when handling an infant. Because of their low seated position and the relatively high side rail of a standard crib, wheelchair using caretakers are unable to independently transfer their baby into or out of a standard crib. In addition, many wheelchair users cannot use their legs to stabilize themselves. Because of this, holding a weight, such as an infant, off-center can cause them to become extremely unstable and be at risk of both falling and/or dropping the infant.

This crib 1 was initially designed to assist wheelchair bound caretakers. However, it may also be useful for any caretaker who suffers from a condition that makes it painful or dangerous to bend over and lift. For example, people with back problems, who are not in wheelchairs, may also benefit from the invention.

While several attempts have been made to design a crib to accommodate the needs of wheelchair using caretakers, there is specifically lacking, in the area of cribs, a design that provides a carriage that is normally low to the ground but can elevate when needed, thereby allowing for full passage underneath of the structure by the wheelchair using caretaker.

For example, U.S. Pat. No. 6,618,877 provides an elevated mattress that permits full passage underneath the structure however; the carriage itself cannot be lowered to the ground position. With its elevated position being a fixed position, a baby is at greater risk of injury from falls when they become of age where they can climb out of the structure. The child, when climbing over the sidewall of an elevated structure has a dangerously high potential energy due to the height of the elevated crib.

An exemplary embodiment of the disclosed crib 1 addresses this need by providing the user with the ability to elevate the crib when needed, and then return the crib 1 to a lower position, where a child in the crib will have a lower potential energy.

Furthermore U.S. Pat. No. 6,618,877 utilizes a single large panel sliding door to gain access to the interior of the crib. The depicted preferred embodiment of '877 uses a latch point at one end of the sliding panel. This is problematic because the design requires the caretaker to be physically located on one end of the structure and then, should the caretaker need to reach to the opposite end, the caretaker must reposition their wheelchair. This is especially troublesome when the child is located on the far end of the crib and out of the reach of the caretaker. In this event that the child is located at the end of the crib opposite from the latch, the wheelchair user will need to first position themselves within reach of the door latch at the latch end of the crib to disengage the latch. Then after disengaging the latch and opening the door, the caretaker must relocate themselves to the opposite end of the crib from the latch to reach the child. Next, with the child in hand, the caretaker must attempt to relocate again to the latch end of the structure. This requirement to move back and forth to operate the door system is troublesome to a wheelchair using caretaker.

An exemplary embodiment of the disclosed crib 1 addresses this problem by utilizing a two panel sliding door front wall 100 wherein the interface between the left sliding door 160 and right sliding door 180 (where the right edge 162*b* of left sliding door panel 162 meets the left edge 181*b* of right sliding door panel 181) and the latches and locks (primary latch 165 and secondary latch 166) are all in one centrally located area on crib 1. Thereby, disclosed crib 1 does not require a wheelchair user to relocate themselves to operate the doors (left sliding door 160 and right sliding door 180) as the location of the door latches position the wheelchair using caretaker (user) at an optimal location to reach into the far corners of the interior (sleeping area 11) of crib 1.

Another attempted solution, U.S. Pat. No. 8,646,126 provides a design that can raise and lower the structure. However, the access system into the mattress area utilizes a door that opens downward and blocks the underneath of the structure creating an entry obstruction for a wheelchair. This obstruction will prevent a wheelchair using caretaker from pulling directly underneath the structure, thereby forcing the wheelchair using caretaker to pull beside the structure and reach and lift off center. This reaching and lifting off center creates the previously mentioned stability issue and risk of falls and/or drop. In addition, the wheelchair using caretaker will have a limited reach into the interior of the structure as they cannot pull close enough to or under the structure. The present invention allows for access to the child using a unique sliding door system that maintains an open space underneath the elevated carriage as to allow passage of a wheelchair user's chair and lap.

Turning to FIGS. 1-5B, 13-14, and 19 the crib 1 includes a carriage 10 and a base 800 having a two column lifting system (left lifting column 205 and right lifting column 405) to raise carriage 10 to an elevated position and lower carriage 10 to a lowered (ground) position. Carriage 10 has a box structure that defines sleeping area 11 that effectively acts to contain the child. Crib 1 has and the box structure (open top box structure) of carriage 10 of crib 1 is defined by a rear wall 300, left wall 200, right wall 400, front wall 100, and mattress support 600. Front wall 100 has a sliding door 101. In an exemplary embodiment, sliding door 101 can include a left sliding door 160 and a right sliding door 180. Left lifting column 205 attached to left wall 200 and right lifting column 405 attached to right wall 400 move carriage 10 of crib 1 between a lowered position and elevated (lifted) position.

In an exemplary embodiment of crib 1, the right edge 162*b* of left sliding door panel 162 meets the left edge 181*b* of right sliding door panel 181 at about a horizontal center of said front wall 100, when said left sliding door panel 162 and said right sliding door panel 181 are in a closed position. In an exemplary embodiment of crib 1, the right edge 162*b* of left sliding door 160 meets the left edge 181*b* of right sliding door 180 at about a horizontal center of said front wall 100, when said left sliding door 160 and said right sliding door 180 are in a closed position.

In an exemplary embodiment of crib 1, the right edge 162*b* of left sliding door panel 162 moves away from the left edge 181*b* of right sliding door panel 181, when the left sliding door panel 162 and the right sliding door panel 181 of the front wall 100 are transitioning from a closed position to an open position. In an exemplary embodiment of crib 1, the right edge 162*b* of left sliding door 160 moves away from the left edge 181*b* of right sliding door 180, when the left sliding door 160 and the right sliding door 180 of the front wall 100 are transitioning from a closed position to an open position.

The large panel components of the crib 1, such as a rear wall 300, left wall 200, right wall 400, front wall 100, are constructed using a solid surface plastic machined from sheet stock. The solid material is easy to clean and does not show scratching or marring. Furthermore, the solid surface material will not chip or splinter.

Base 800 includes left lifting column 205, right lifting column 405, horizontal bar assembly 500, left foot 213, and right foot 413, which are discussed in further detail below. In some exemplary embodiments of crib 1, base 800 can be biased forward with regard to carriage 10, which can increase stability of crib 1, when a load is applied to crib 1 located closer to front wall 100 than rear wall 300, such as when a caregiver is tending to a child in sleeping area 11 of crib 1. Stated alternatively, in an exemplary embodiment, left lifting column 205 can be mounted to left foot 213 biased toward the rear 213*b* of left foot 213 and right lifting column 405 can be mounted to right foot 413 biased toward the rear 413*b* of left foot 413, which can increase stability of crib 1, when a load is applied to crib 1 located closer to front wall 100 than rear wall 300, such as when a caregiver is tending to a child in sleeping area 11 of crib 1.

Figure 2:
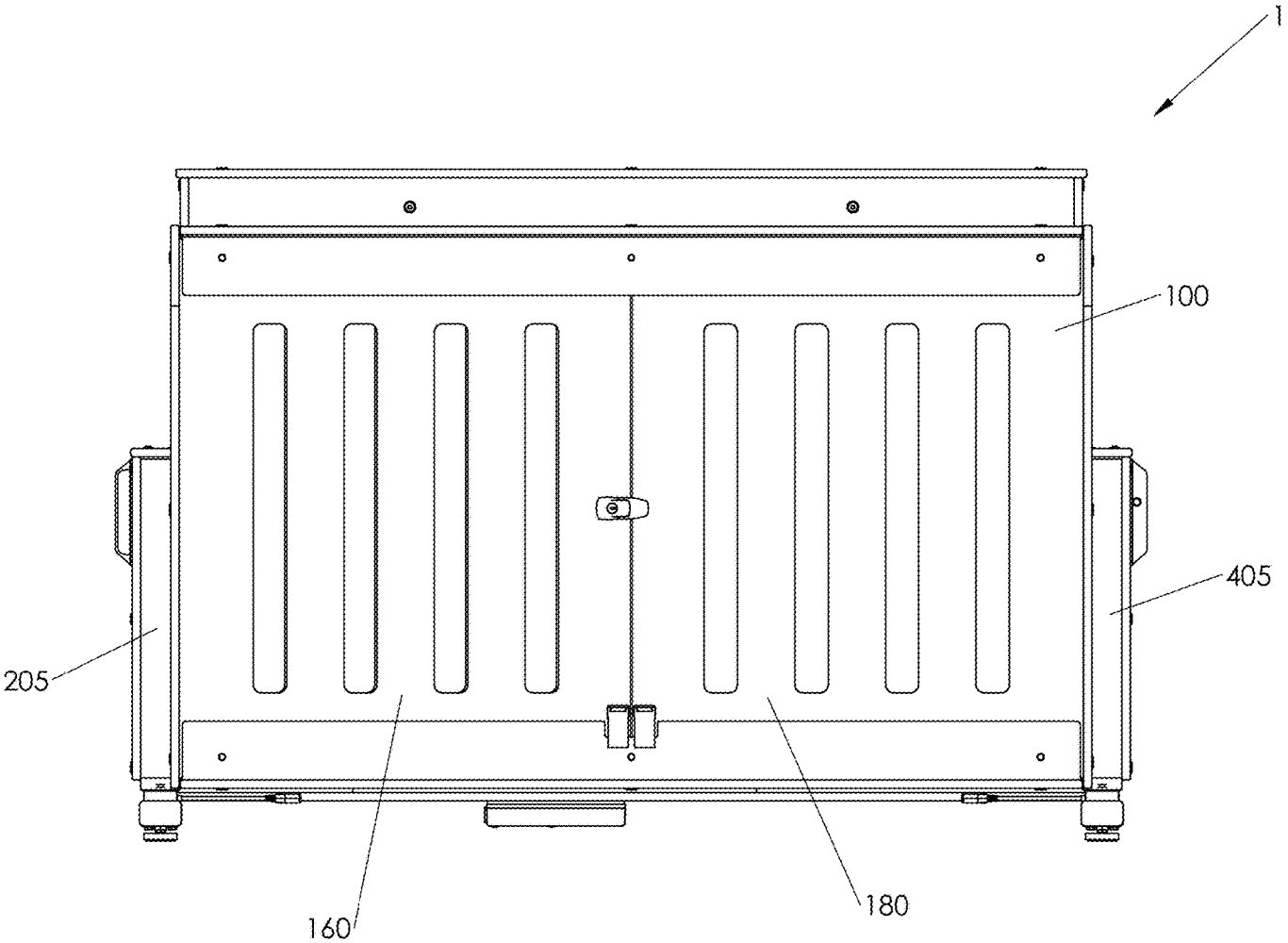
FIG. 2 is a front view of a crib in accordance with an exemplary embodiment of the invention.
Figure 3:
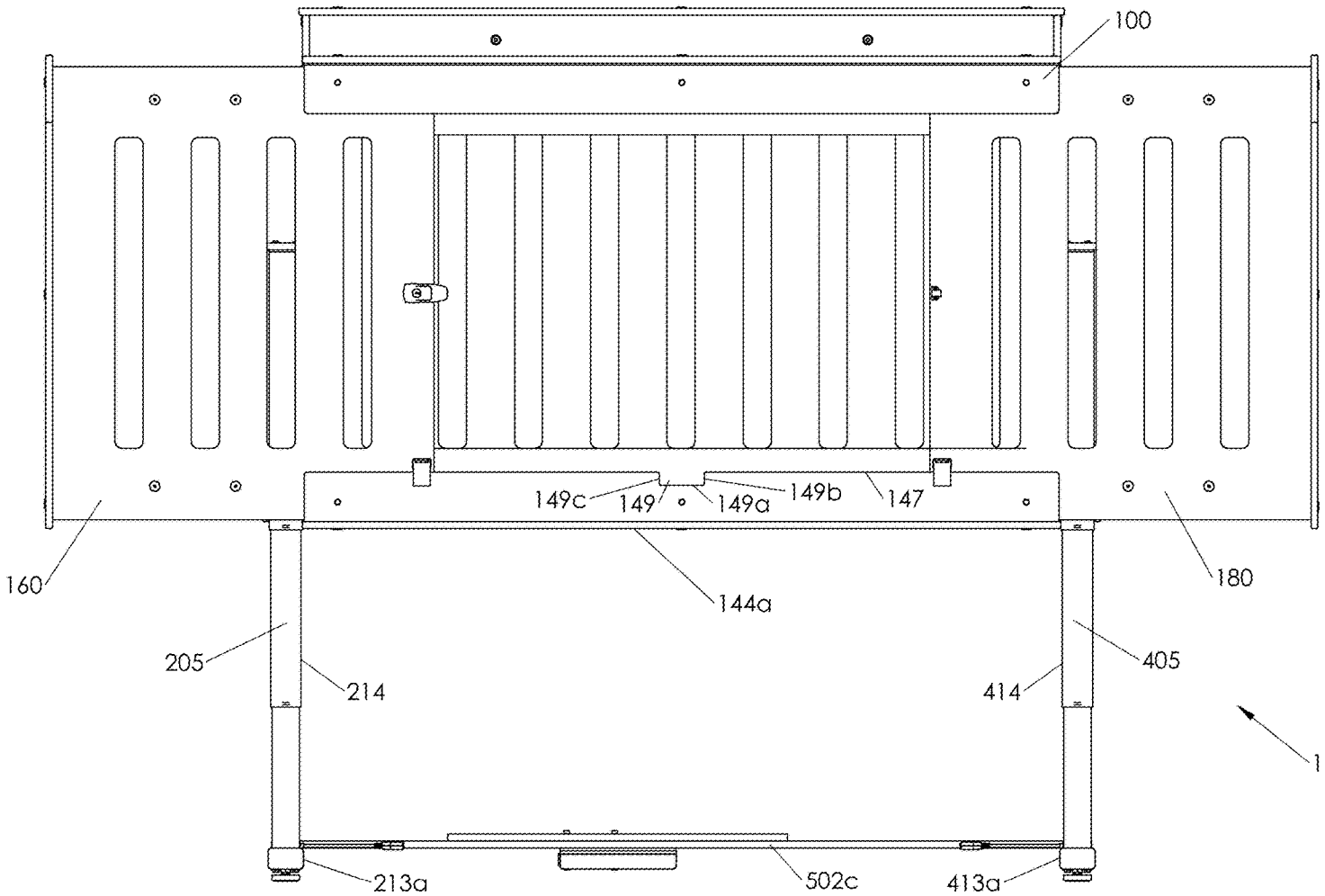
FIG. 3 is a front view of a crib in the elevated position in accordance with an exemplary embodiment of the invention.
Figure 4A:
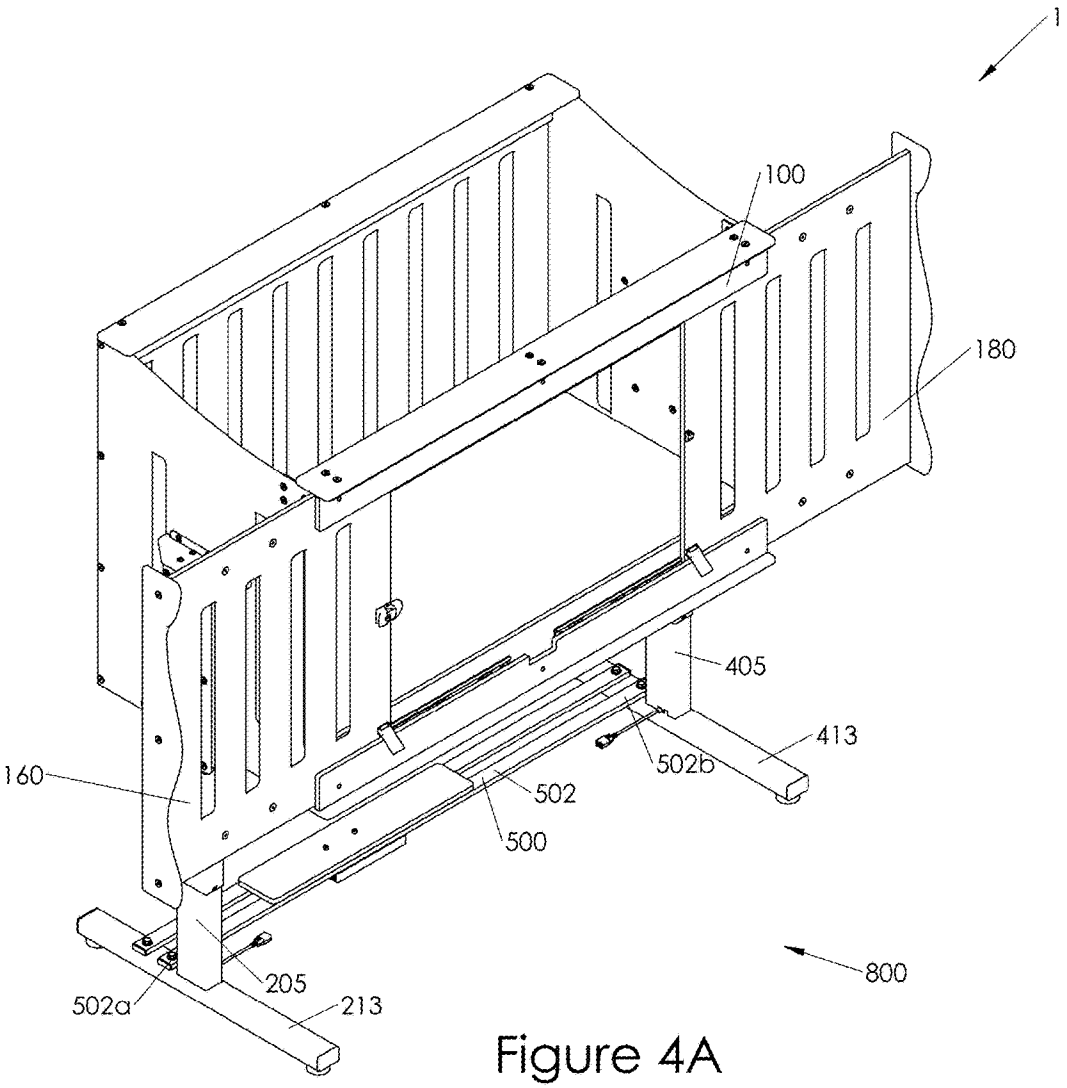
FIG. 4A is a perspective view of a crib in the elevated position with the doors open in accordance with an exemplary embodiment of the invention.
Figure 4B:
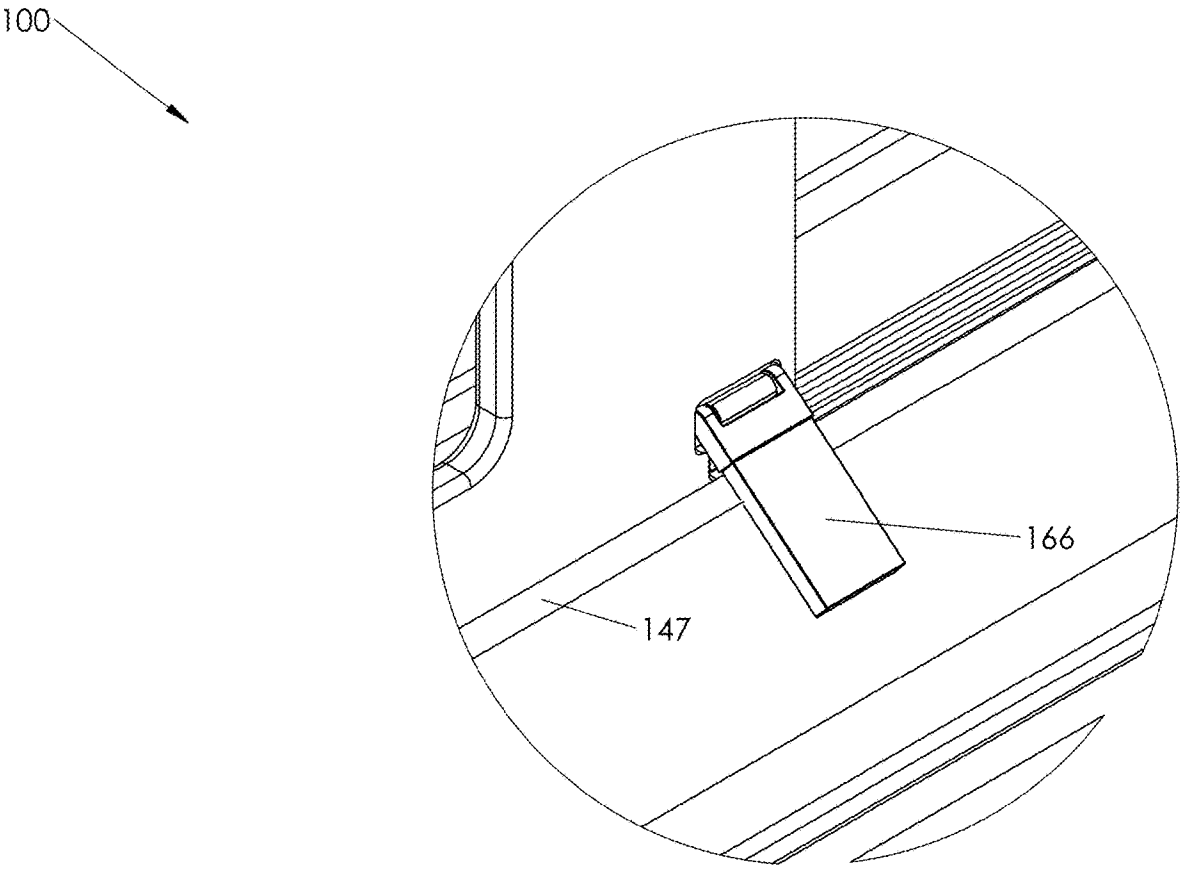
FIG. 4B is a zoomed view of a secondary latch in the unlocked position in accordance with an exemplary embodiment of the invention.
Figure 4C:
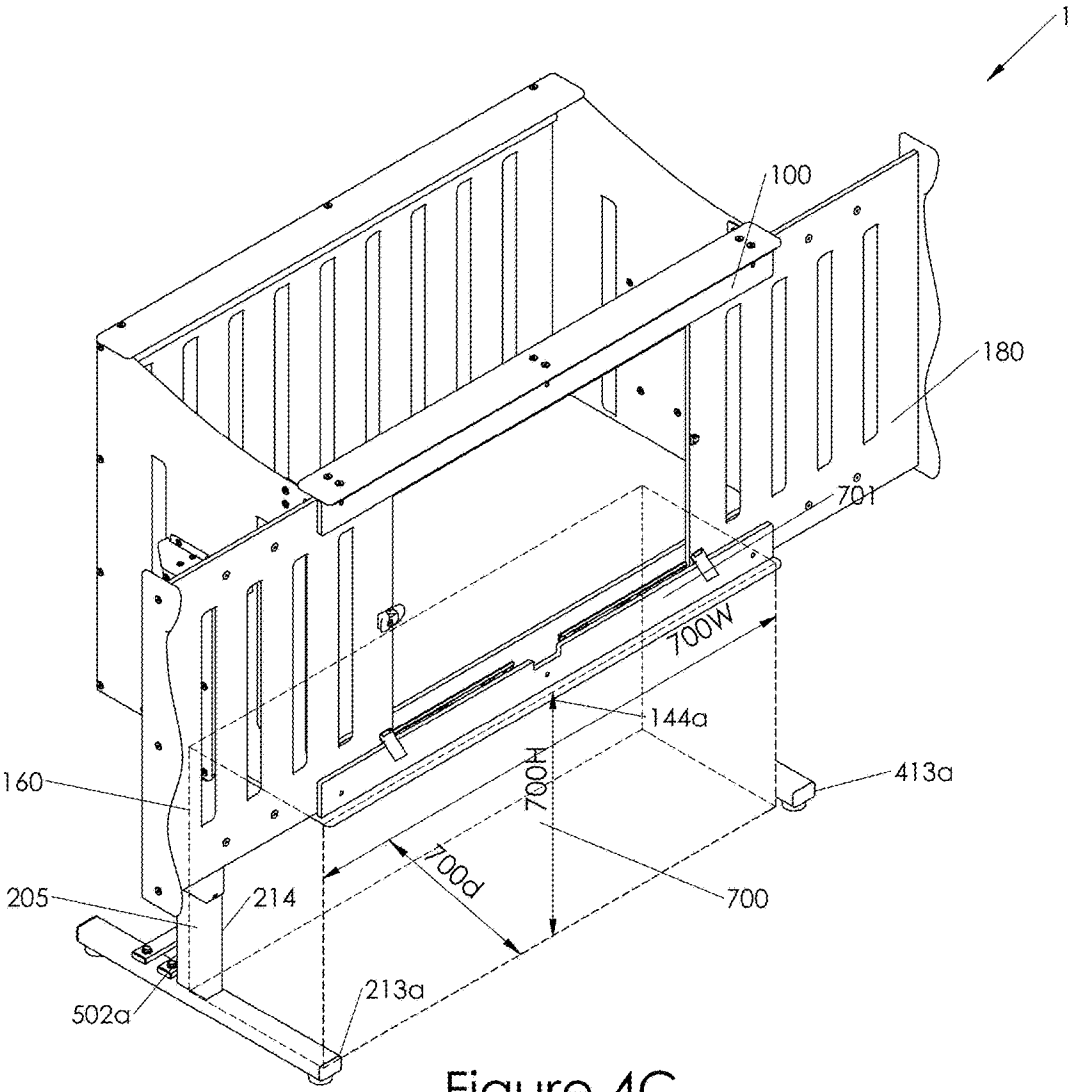
FIG. 4C is a perspective view of a crib in the elevated position with the doors open in accordance with an exemplary embodiment of the invention.
Figure 5A:
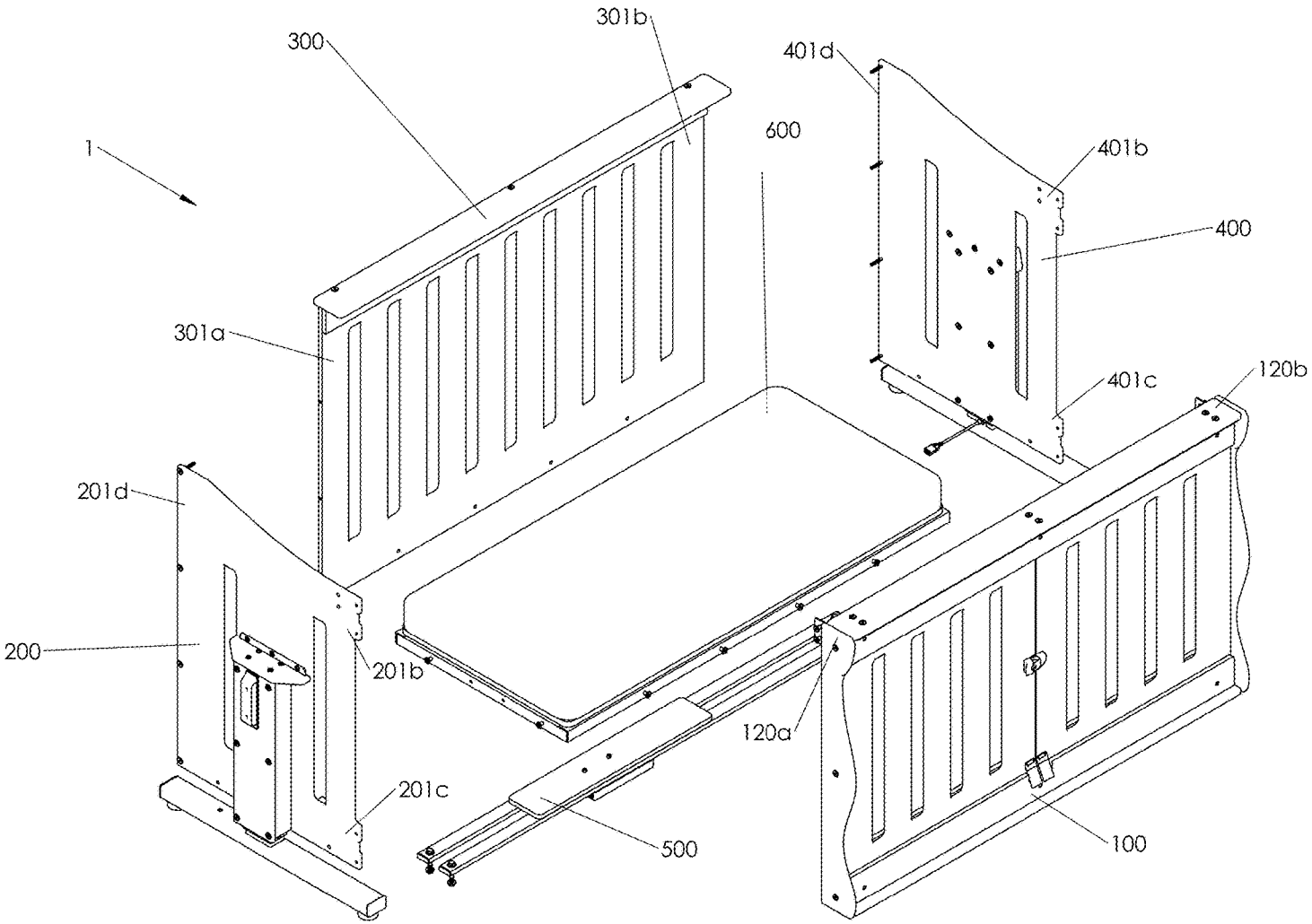
FIG. 5A is an exploded view of a crib in accordance with an exemplary embodiment of the invention.
Figure 5B:
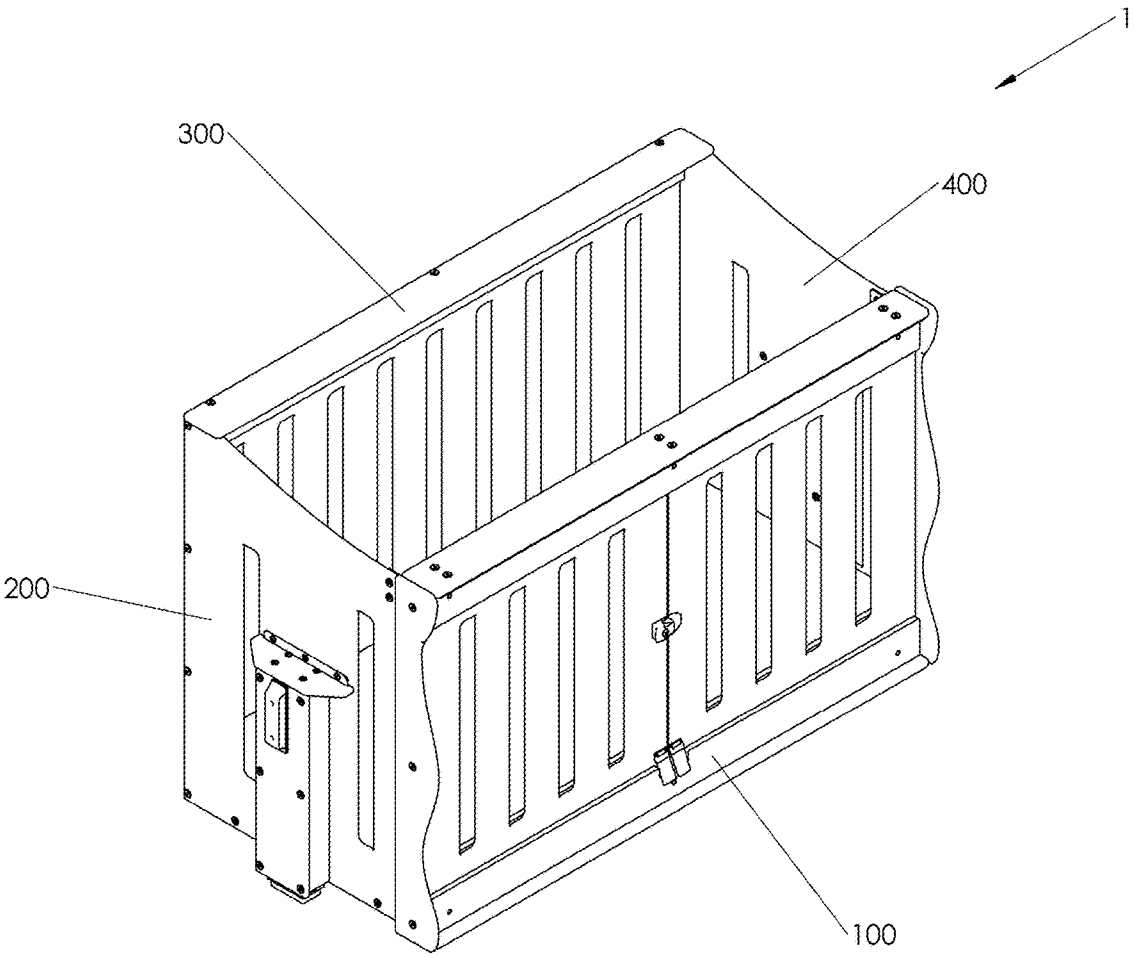
FIG. 5B is a perspective view of a carriage of a crib in with the doors closed in accordance with an exemplary embodiment of the invention.
Figure 6:
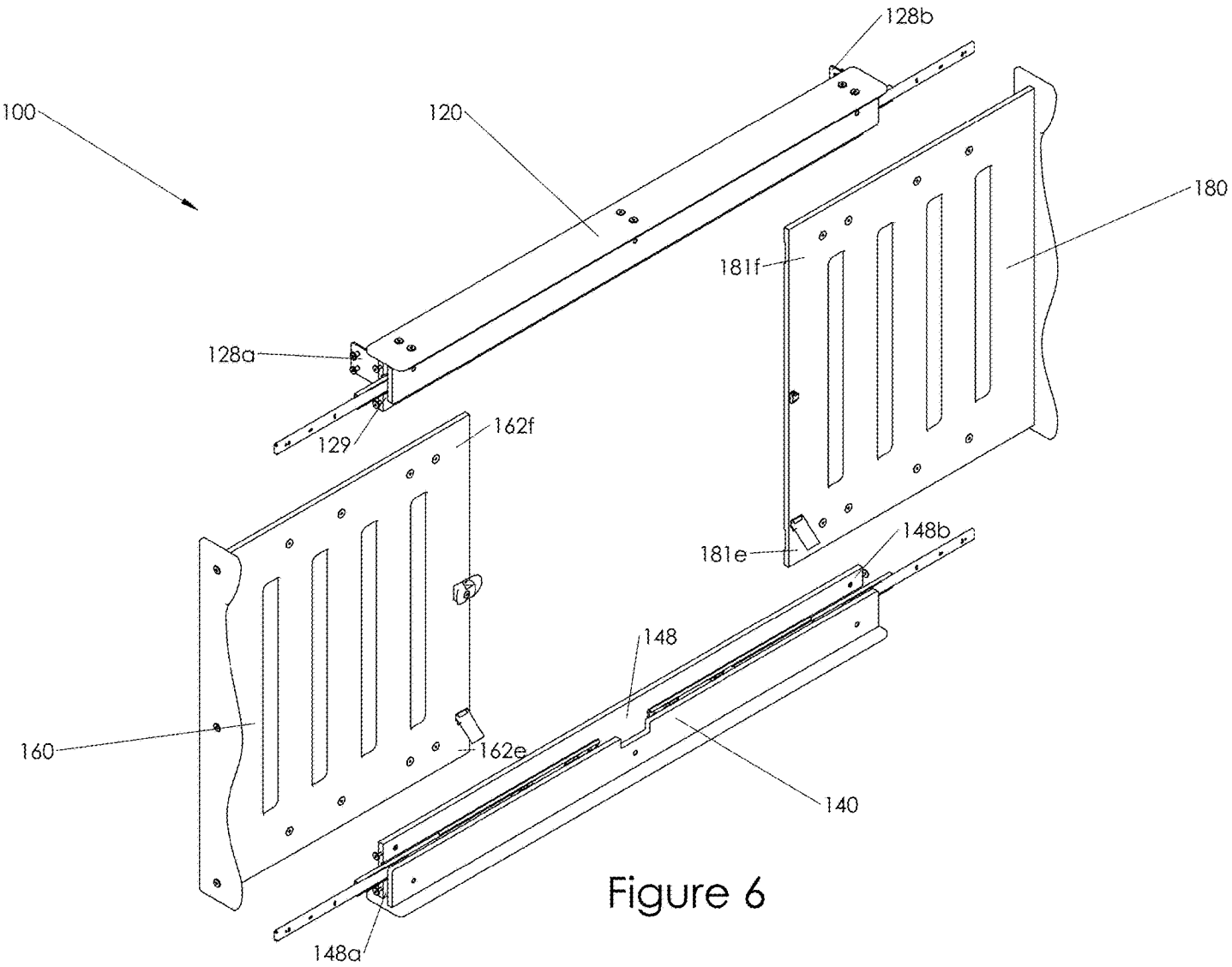
FIG. 6 is an exploded view of a front wall of a crib in accordance with an exemplary embodiment of the invention.
Figure 7:
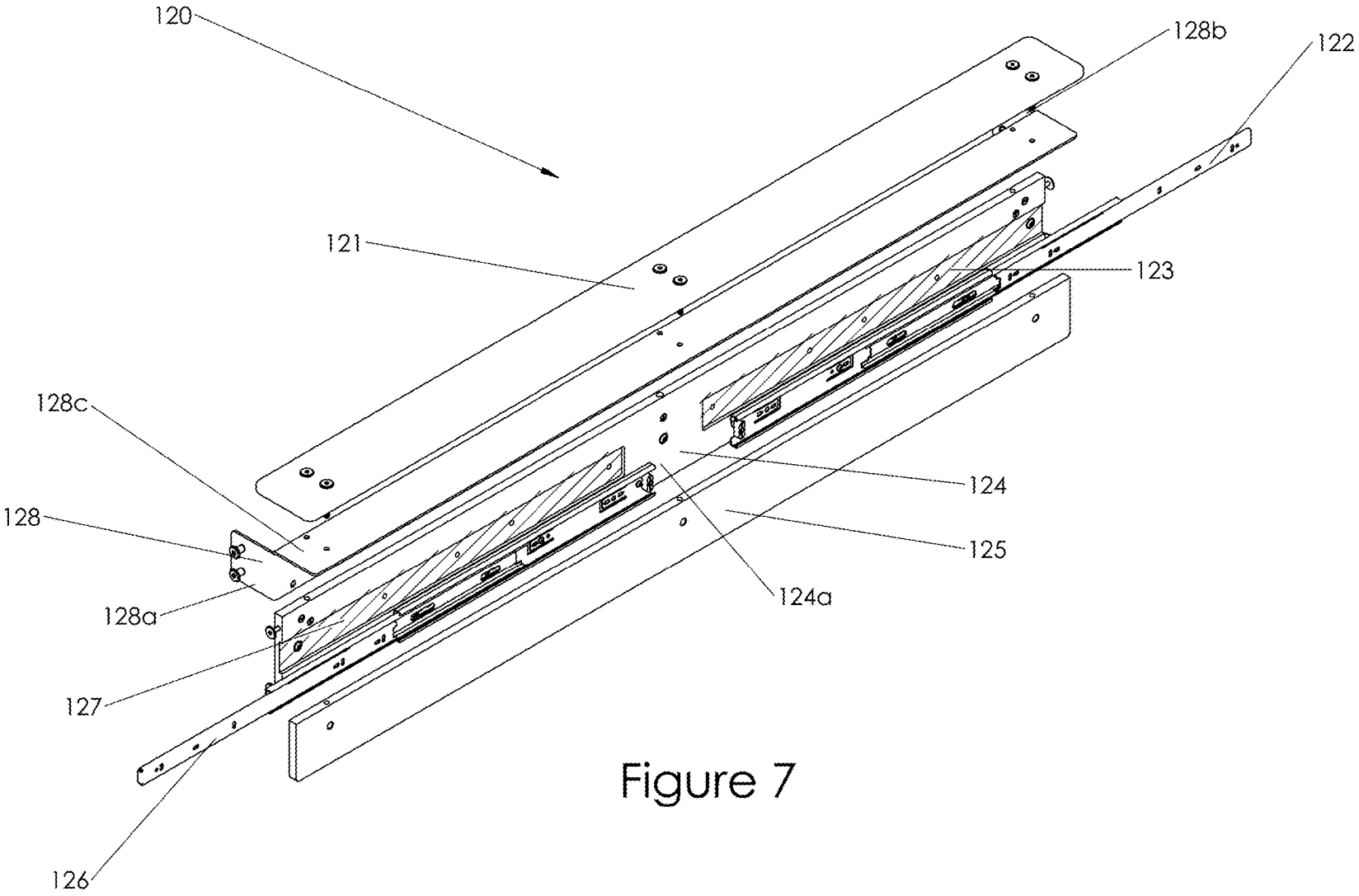
FIG. 7 is an exploded view of an upper door slide of a crib in accordance with an exemplary embodiment of the invention.
Figure 8A:
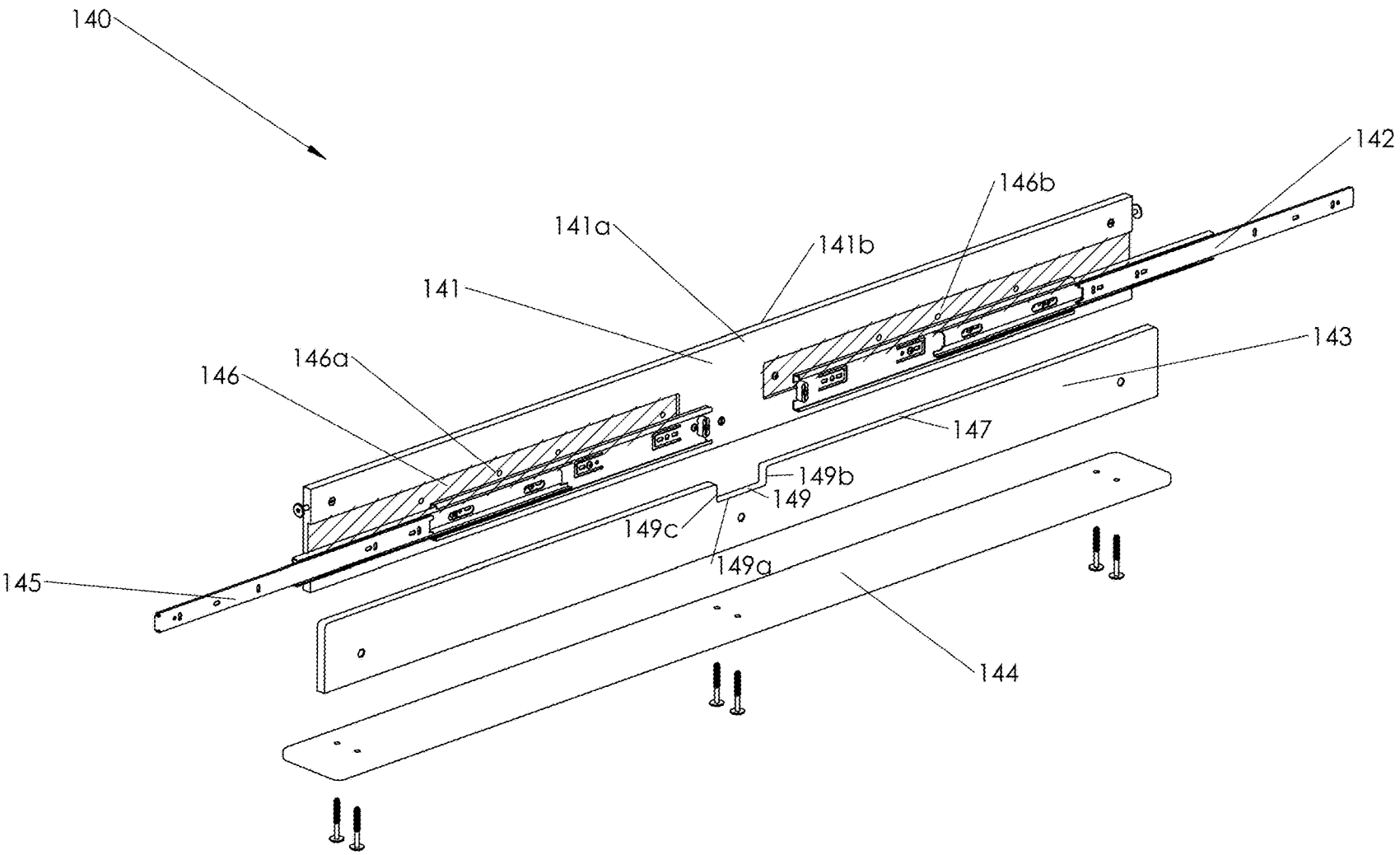
FIG. 8A is an exploded view of a lower door slide of a crib in accordance with an exemplary embodiment of the invention.
Figure 8B:
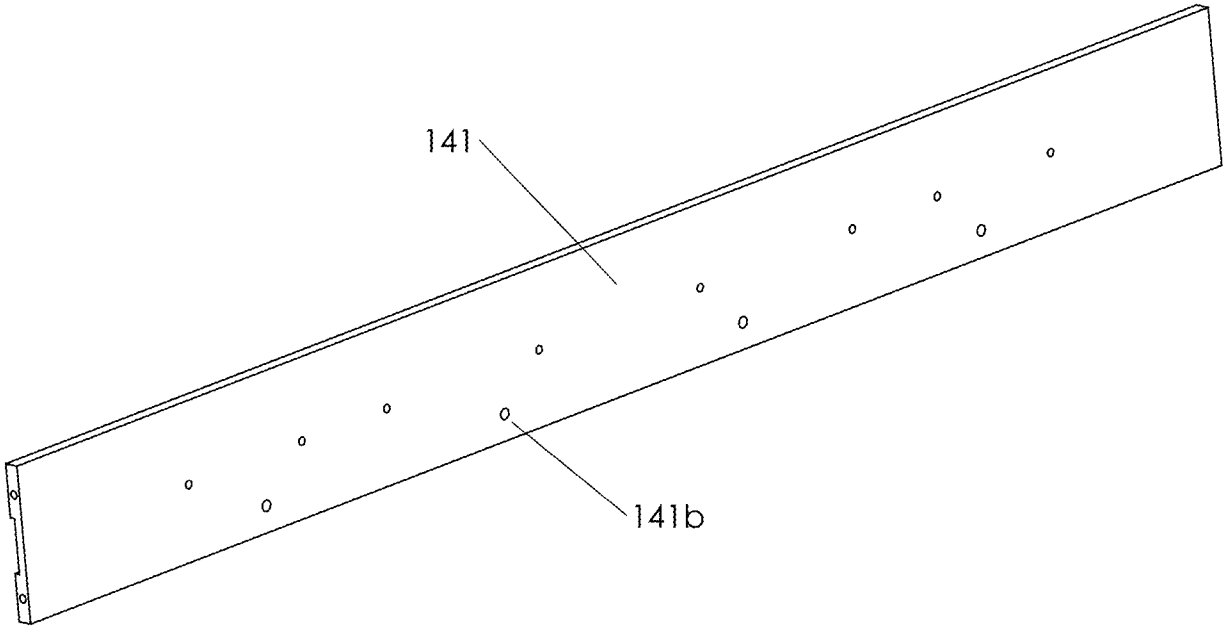
FIG. 8B is a perspective view of a lower door slide support member of a crib in accordance with an exemplary embodiment of the invention.
Figure 9:
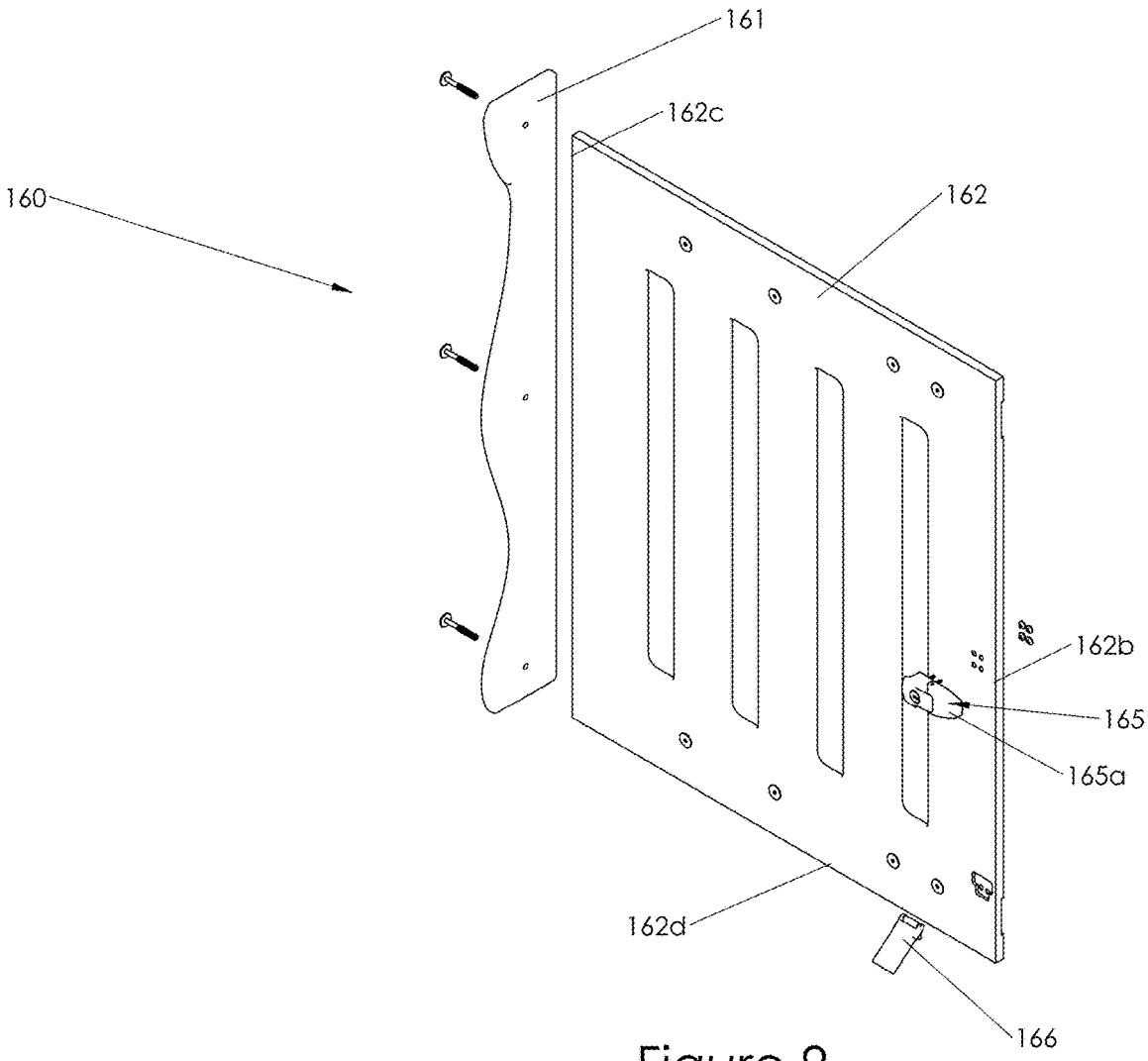
FIG. 9 is a front perspective exploded view of a left sliding door of a crib in accordance with an exemplary embodiment of the invention.
Figure 10:
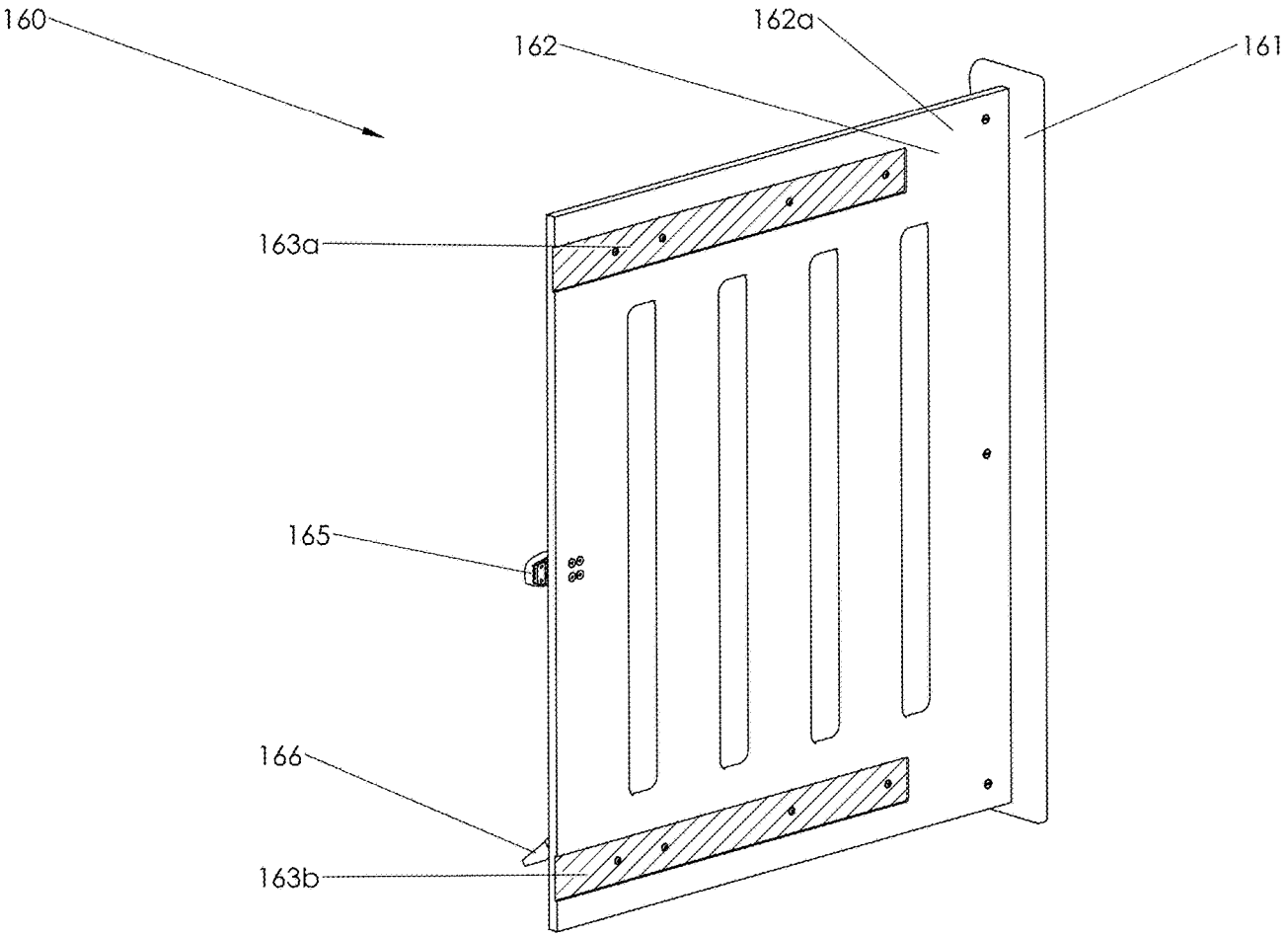
FIG. 10 is a rear perspective exploded view of a left sliding door of a crib in accordance with an exemplary embodiment of the invention.
Figure 11:
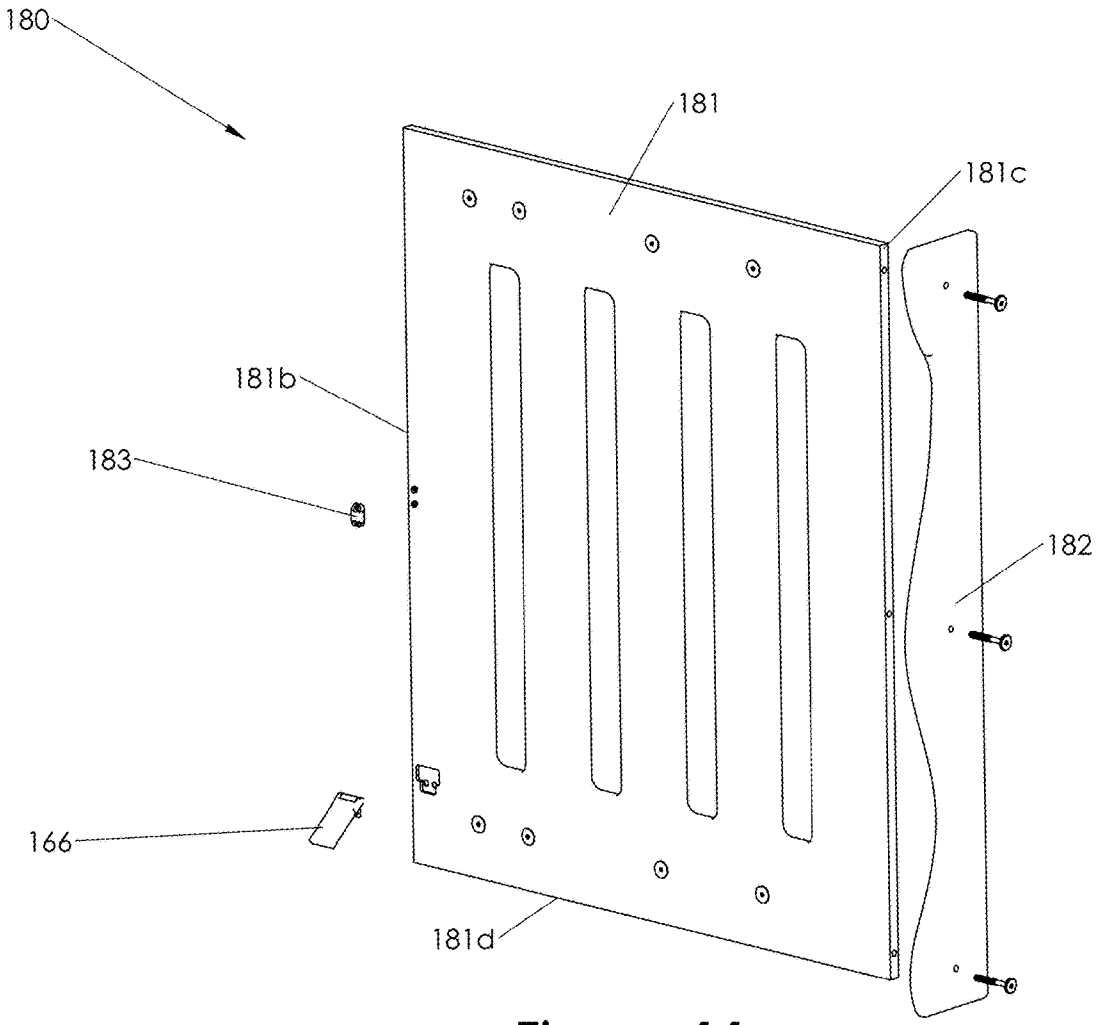
FIG. 11 is a front perspective exploded view of a right sliding door of a crib in accordance with an exemplary embodiment of the invention.
Figure 12:
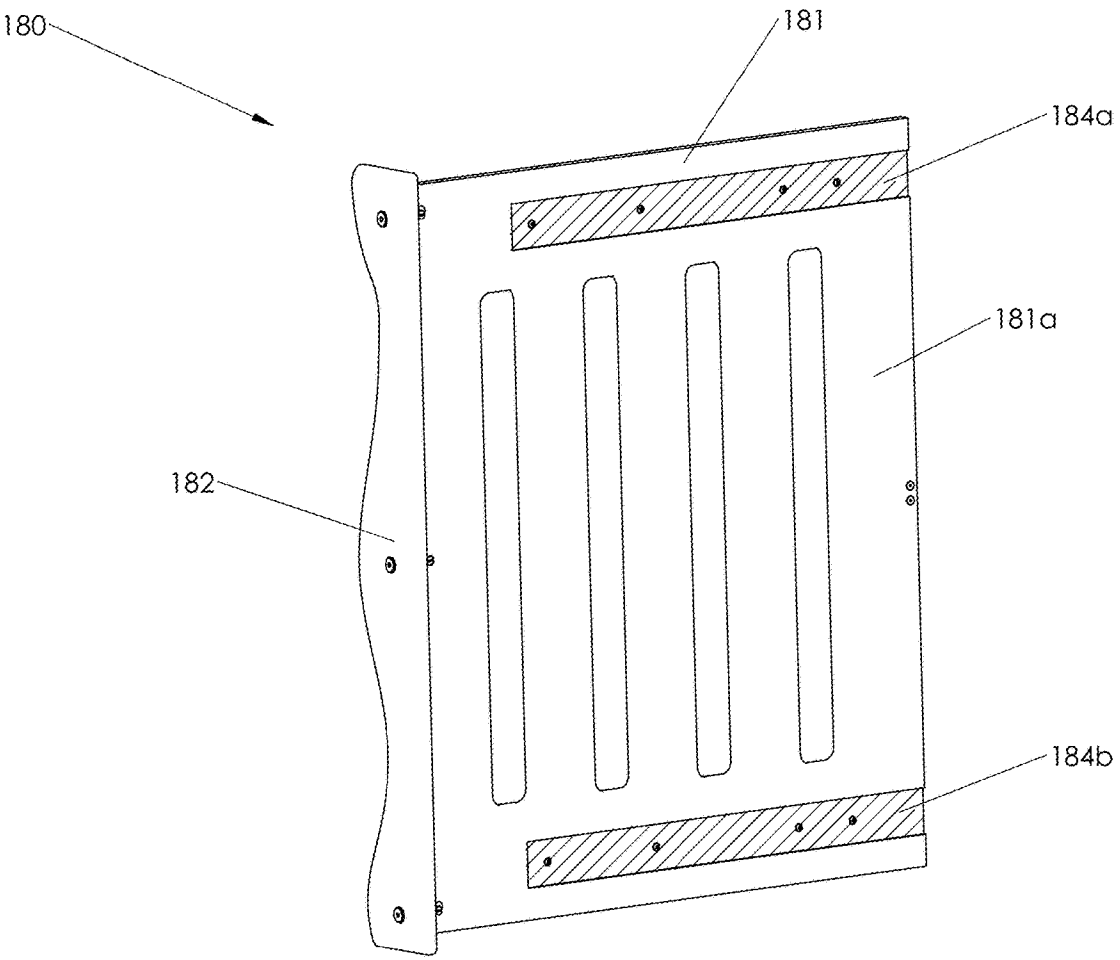
FIG. 12 is a rear perspective exploded view of a right sliding door of a crib in accordance with an exemplary embodiment of the invention.

FIGS. 1-2 depict the crib 1 in the lowered position and FIGS. 3-4A depict the crib 1 in an elevated position. The lowered position of crib 1 shown in FIGS. 1-2 is considered the normal in-use position and is the preferred, low potential energy position for use when the child is occupying the crib 1. FIG. 3 depicts the embodiment in an elevated position, while FIG. 4A depicts the embodiment in the elevated position with one or both of the left sliding door 160 and/or right sliding door 180 of the front wall 100, open. The elevated position of crib 1 as depicted in FIG. 4A, is utilized when a wheelchair using caretaker needs to gain access to or place a child in sleeping area 11 of crib 1. It can be observed that while the carriage 10 of crib 1 is in the elevated position, the full unobstructed passage in the underneath portion of the carriage is provided to allow wheelchair using caretakers to pull underneath the carriage. Upon completion of interfacing with the child, the caretaker can return the carriage 10 to the lowered position, as depicted in FIGS. 1 and 2.

Turning back to 1-5, 13-14, and 19, horizontal bar assembly 500 increases rigidity when carriage 10 of crib 1 is in the elevated position. Horizontal bar assembly 500 has at least one bar 502 fastened to and spanning between left foot 213 and right foot 413. In an exemplary embodiment two horizontal steel bars 502 span between the fasten to left foot 213 and right foot 413 using fasteners, such as bolts, washers, and nuts. A first end 502*a* of bar 502 can be fastened to a top face 213*e* of left foot 213 and a second end 502*b* of bar 502 can be fastened to a top face 413*e* of right foot 413. In an exemplary embodiment, the first end 502*a* of bar 502 can be fastened to a top face 213*e* of left foot 213 between rear 213*b* of left foot 213 and left side lifting column 205. The second end 502*b* of bar 502 can be fastened to a top face 413*e* of right foot 413 between rear 413*b* of right foot 413 and right side lifting column 405. Since the bars 502 are located behind the left lifting column 205 and right lifting column 405, such that they are located toward the rear 213*b* of left foot 213 and toward the rear 413*b* of right foot 413, the bars 502 do not interfere with a caregiver pulling a wheelchair under the carriage 10, when the crib 1 is in the elevated position.

Bar 502 helps to maintain the horizontal spacing between the left foot 213 and right foot 413. Further, bar 502 helps to prevent left foot 213 from rotating about left lifting column 205 and right foot 413 from rotating about right lifting column 405, such as when the carriage 10 of the crib 1 is in the elevated position and a lateral horizontal force is applied to the crib 1, such as by rocking the crib 1 left to right by the occupant or user.

In an exemplary embodiment, all connections of crib 1 made by fasteners utilize a metal-to-metal design with low profile Furniture bolts and cap nut hardware having soft-to-touch edges. Every connection point utilizes thread locking agent to ensure hardware will remain in place and will not loosen with structural movements of crib 1.

Referring to FIGS. 6-12, front wall 100 has an upper door slide 120, a lower door slide 140, a left sliding door 160 and a right sliding door 180. The left end 120*a* of the upper door slide 120 is fastened to the upper front 201*b* of left wall panel 201 of left wall 200 and left end 148*a* of the lower door slide 140 is fastened to the lower front 201*c* of left wall panel 201 of left wall 200. In an exemplary embodiment, the left end 128*a* of header 128 of upper door slide 120 of front wall 100 is fastened to the upper front 201*b* of left wall panel 201 of left wall 200.

The right end 120*b* of the upper door slide 120 is fastened to the upper front 401*b* of right wall panel 401 of right wall 400 and right end 148*b* of the lower door slide 140 is fastened to the lower front 401*c* of right wall panel 401 of right wall 400. In an exemplary embodiment, the right end 128*b* of header 128 of upper door slide 120 of front wall 100 is fastened to the upper front 401*b* of right wall panel 401 of right wall 400.

A rear portion 201*d* of the left wall panel 201 of left wall 200 is fastened to a left end 301*a* of rear wall panel 301 of rear wall 300, and a rear portion 401*d* of the right wall panel 401 of right wall 400 is fastened to a right end 301*b* of rear wall panel 301 of rear wall 300.

In some embodiments, the upper door slide 120 includes a header 128 that provides rigidity and strength to upper door slide 120 and crib 1. Thereby, header 128 helps to ensure that upper door channel and lower door channel maintain their orientation and position, which allows left sliding door 160 and right sliding door 180 to open and close. Additionally, a left end 128*a* of header 128 attaches to the left wall panel 201 of left wall 200, and a right end 128*b* of header 128 attaches to the right wall panel 401 of right wall 400, thereby supporting the box structure of the carriage 10. In an embodiment, a main body 128*c* of header 128 is located below a top panel 121 of the upper door slide 120. Main body 128*c* is located between left end 128*a* and right end 128*b*. Further, header 128 is located above upper door slide support member 124 and upper door retainer 125.

The left sliding door 160 and right sliding door 180 are attached to upper door slide 120 and lower door slide 140 using roller bearing slides, such that the left sliding door 160 and right sliding door 180 slide horizontally with respect to crib 1. In an exemplary embodiment, left sliding door 160 and right sliding door 180 are attached to upper door slide 120 and lower door slide 140 using upper right slide 122, upper left slide 126, lower right slide 142, and lower left slide 145. More specifically, left sliding door 160 is slidingly attached to the upper door slide support member 124 of upper door slide 120 using upper left slide 126. Right sliding door 180 is slidingly attached to the upper door slide support member 124 of upper door slide 120 using upper right slide 122. Left sliding door 160 is slidingly attached to the lower door slide support member 141 of lower door slide 140 using lower left slide 145. Right sliding door 180 is slidingly attached to the lower door slide support member 141 of lower door slide 140 using lower right slide 142.

In an exemplary embodiment, the right edge 162*b* of left sliding door panel 162 and the left edge 181*b* of right sliding door panel 181 meet at about middle (horizontal center) of the front wall 100 when the right sliding door 180 and left sliding door 160 are in a closed position.

The upper door slide support member 124 and lower door slide support member 141 contain pockets 146*a*, 146*b*, 127, and 123 for mounting a first face of the roller bearing slides 122, 126, 142, 145. The left sliding door panel 162 and right sliding door panel 181 also contain pockets 163*a*, 163*b*, 184*a*, and 184*b*, wherein a second face of the roller bearing slides 122, 126, 142, 145 are mounted.

In an exemplary embodiment, lower left slide 145 can be mounted in a left pocket 146*a* on a channel face 141*a* of lower door slide support member 141, and lower right slide 142 can be mounted in a right pocket 146*b* in the channel face 141*a* of lower door slide support member 141. Further, upper left slide 126 can be mounted in a left pocket 127 in the channel face 124*a* of the upper door slide support member 124, and upper right slide 122 can be mounted in a right pocket 123 on the channel face 124*a* of the upper door slide support member 124.

Further, in an exemplary embodiment, lower left slide 145 can be mounted in a lower pocket 163*b* on an inside face 162*a* of the panel 162 of the left sliding door 160, and upper left slide 126 can be mounted in an upper pocket 163*a* on an inside face 162*a* of the panel 162 of the left sliding door 160. Further, in an exemplary embodiment, lower right slide 142 can be mounted in a lower pocket 184*b* on an inside face 181*a* of the panel 181 of the right sliding door 180, and upper right slide 122 can be mounted in an upper pocket 184*a* on an inside face 181*a* of the panel 181 of the right sliding door 180.

Since the roller bearing slides 122, 126, 142, 145 are recessed in pockets on both faces between the slide support members and the sliding door panels, any gap between the sliding doors and the mattress is less than about 3/16".

Stated alternatively, since the roller bearing slides 122, 126, 142, 145 are recessed in pockets on both faces between the lower door slide support member 141 and upper door slide support member 124, and the left sliding door panel 162 and right sliding door panel 181, any gap between the left sliding door 160 and right sliding door 180 and the mattress 610 is less than about 3/16".

The upper door slide 120 has an upper door retainer 125, and the lower door slide 140 has a lower door retainer 143. This upper door retainer 125 and lower door retainer 143 keep the left sliding door 160 and right sliding door 180 from inadvertently falling off crib 1 or into the sleeping area 11 of crib 1, in the event that one or more of the roller bearing slides 122, 126, 142, 145 should ever fail and fall off track.

Stated alternatively, the upper door slide 120 has an upper door retaining channel 129. The upper door retaining channel 129 is formed by upper door slide support member 124, upper door retainer 125 and header 128. In embodiments of crib 1 not equipped with header 128, the upper door retaining channel 129 is formed by upper door slide support member 124, upper door retainer 125 and top panel 121. The upper door retaining channel 129 contains an upper portion 162*f* of left sliding door panel 162 and an upper portion 181*f* of right sliding door panel 181. The upper door retaining channel 129 has sufficient depth and is configured to retain the upper portion 162*f* of left sliding door panel 162 and the upper portion 181*f* of right sliding door panel 181, in the event that one or more of the roller bearing slides 122, 126, 142, 145 should ever fail and/or fall off track.

Further, the lower door slide 140 has a lower door retaining channel 148. The lower door retaining channel 148 is formed by the lower door slide support member 141, lower door retainer 143, and bottom panel 144. Lower door slide support member 141 and lower door retainer 143 are mounted to the bottom panel 144. The lower door retaining channel 148 contains a lower portion 162*e* of left sliding door panel 162 and a lower portion 181*e* of right sliding door panel 181. The lower door retaining channel 148 has sufficient depth and is configured to retain the lower portion 162*e* of left sliding door panel 162 and a lower portion 181*e* of right sliding door panel 181, in the event that one or more of the roller bearing slides 122, 126, 142, 145 should ever fail and/or fall off track.

In consideration of various access door designs, the configuration of front wall 100 maintains rigidity for the carriage 10 when left sliding door 160 and/or right sliding door 180 open or closed. This is due to the fact the rigidity, strength, load bearing, and load sharing, provided by upper door slide 120 and lower door slide 140, which are fixed to and support the right wall 400 and left wall 200 at the front of crib 1, irrespective of the state of the left sliding door 160 and right sliding door 180.

Other door designs, such as swinging hinged doors without a upper door slide 120 and/or lower door slide 140, depend on the door at the front of the crib to maintain rigidity of the crib. Thereby, when the door in the other designs is open and not providing support, the right wall 400 and left wall 200 can be overloaded, thereby reducing the overall strength and rigidity of the carriage 10 when the doors are open. This is unlike the front wall 100 of crib 1, which maintains the rigidity of carriage 10 due to the upper door slide 120 and lower door slide 140 remaining static as the left sliding door 160 and right sliding door 180 open and close.

Turning to FIGS. 1B, 3, 4B, 9-11, and 20, the front wall 100 has a latch. In an exemplary embodiment, the latch can be a redundant locking system having a primary latch 165 and a secondary latch 166. Primary latch 165 can be a pull over latch. In an exemplary embodiment, primary latch 165 can be key locked to prevent a child from tampering with the mechanism, such as accidentally unlatching primary latch 165. In an exemplary embodiment, the strike 165*a* of primary latch 165 is mounted near a right edge 162*b* of left sliding door panel 162 and the catch 183 is mounted near a left edge 181*b* of right sliding door panel 181, such that the strike 165*a* and catch 183 of primary latch can close and lock when the left sliding door 160 and right sliding door 180 are in the closed position. In an exemplary embodiment, the strike 165*a* of primary latch 165 is mounted near a right edge 162*b* of left sliding door panel 162 at about the vertical center of left sliding door panel 162, and the catch 183 is mounted near a left edge 181*b* of right sliding door panel 181 at about the vertical center of left sliding door panel 162, such that the strike 165*a* and catch 183 of primary latch can close and lock when the left sliding door 160 and right sliding door 180 are in the closed position.

A left end cap 161 is fastened to a left edge 162*c* of the left sliding door panel 162 and a right end cap 182 is fastened to a right edge 181*c* of the right sliding door panel 181.

Secondary latch 166 can be a latch that automatically latches when a door on which the secondary latch 166 is placed is closed. In one embodiment, secondary latch 166 is a mounting hinge 168 having a stop lever 169. Hinge 168 has a hole 170 configured to receive a pin 167 of the stop lever 169, such that stop lever 169 rotates within the hinge 168 about pin 167. A secondary latch 166 mounted on left sliding door panel 162 can be located near the bottom edge 162*d* and right edge 162*b* of the left sliding door panel 162. A secondary latch 166 mounted on right sliding door panel 181 can be located near the bottom edge 181*d* and left edge 181*b* of the right sliding door panel 181.

In an embodiment, a pinned end 169*a* of the stop lever 169 rotates within hinge 168 about pin 167. Stop lever 169 is contained within notch 149 located at about the center of the lower door retainer 143 of the lower door slide 140, when left sliding door 160 is closed farther than or equal to about a predetermined amount. Notch 149 has a bottom 149*a*, right wall 149*b* and left wall 149*c*. Left sliding door 160 is locked when stop lever 169 of left sliding door 160 is contained within notch 149. Accordingly, left sliding door 160 automatically locks when closed, because stop lever 169 automatically pivots down and enters notch 149, when left sliding door 160 is closed.

Stop lever 169 drops below a top surface 147 of the lower door retainer 143 and rests on a bottom 149*a* of notch 149, thereby engaging notch 149, when left sliding door 160 travels from an open position to a closed position. Stop lever 169 rests upon a top surface 147 of the lower door retainer 143 of the lower door slide 140, when left sliding door 160 is opened more than about a predetermined amount. In an embodiment, the predetermined amount is about 95% closed (or 5% open). In another embodiment, the predetermined amount is about 99% closed (or 1% open).

In the event that the left sliding door 160 is closed more than or equal to about the predetermined amount, thereby causing stop lever 169 to engage notch 149, stop lever 169 will then contact a left wall 149*c* of notch 149, when left sliding door 160 is attempted to be moved to an open position without raising a free end 169*a* of stop lever 169 out of notch 149. The contacting of the left wall 149*c* by stop lever 169 maintains stop lever 169 within notch 149 and prevents left sliding door 160 from opening farther than the predetermined amount, thereby preventing the left sliding door 160 from being accidentally opened farther than the predetermined amount.

Similarly, stop lever 169 drops below a top surface 147 of the lower door retainer 143 and rests on a bottom 149*a* of notch 149, thereby engaging notch 149, when right sliding door 180 travels from an open position to a closed position. Stop lever 169 rests upon a top surface 147 of the lower door retainer 143 of the lower door slide 140, when right sliding door 180 is opened more than about the predetermined amount. Left sliding door 160 is locked when stop lever 169 of left sliding door 160 is contained within notch 149. Accordingly, right sliding door 180 automatically locks when closed, because stop lever 169 automatically pivots down and enters notch 149, when right sliding door 180 is closed.

In the event that the right sliding door 180 is closed more than or equal to about the predetermined amount, thereby causing stop lever 169 to engage notch 149, stop lever 169 will then contact a right wall 149*b* of notch 149, when right sliding door 180 is attempted to be moved to an open position without raising a free end 169*a* of stop lever 169 out of notch 149. The contacting of the right wall 149*b* by stop lever 169 maintains stop lever 169 within notch 149 and prevents right sliding door 180 from opening farther than the predetermined amount, thereby preventing the right sliding door 180 from being accidentally opened farther than the predetermined amount.

Accordingly, to open the left sliding door 160 and right sliding door 180 the user must both unlock and unlatch the primary latch 165, and then lift the stop lever 169 of secondary latch 166 by lifting the free end 169*a* of stop lever 169 on both the left sliding door 160 and right sliding door 180 until the stop lever 169 raises out of the notch 149 that is below the top surface 147 of the lower door retainer 143, the left sliding door 160 and right sliding door 180 can then be slid open and the stop lever 169 of the secondary latch 166 can be observed to rest and slide along the top surface 147 of the lower door retainer 143.

Therefore, when both of the left sliding door 160 and right sliding door 180 are closed, the stop lever 169 automatically engages the notch 149, thereby locking the left sliding door 160 and right sliding door 180 in place, even in the event of a failure of the primary latch 165. The primary latch 165 can also be locked in place as well. Both the primary latch 165 and the secondary latch 166 feature large easy to handle levers and require little force. These characteristics are desirable as many of the users will have disabilities that degrade their hand/finger strength and fine motor skills.

Figure 13:
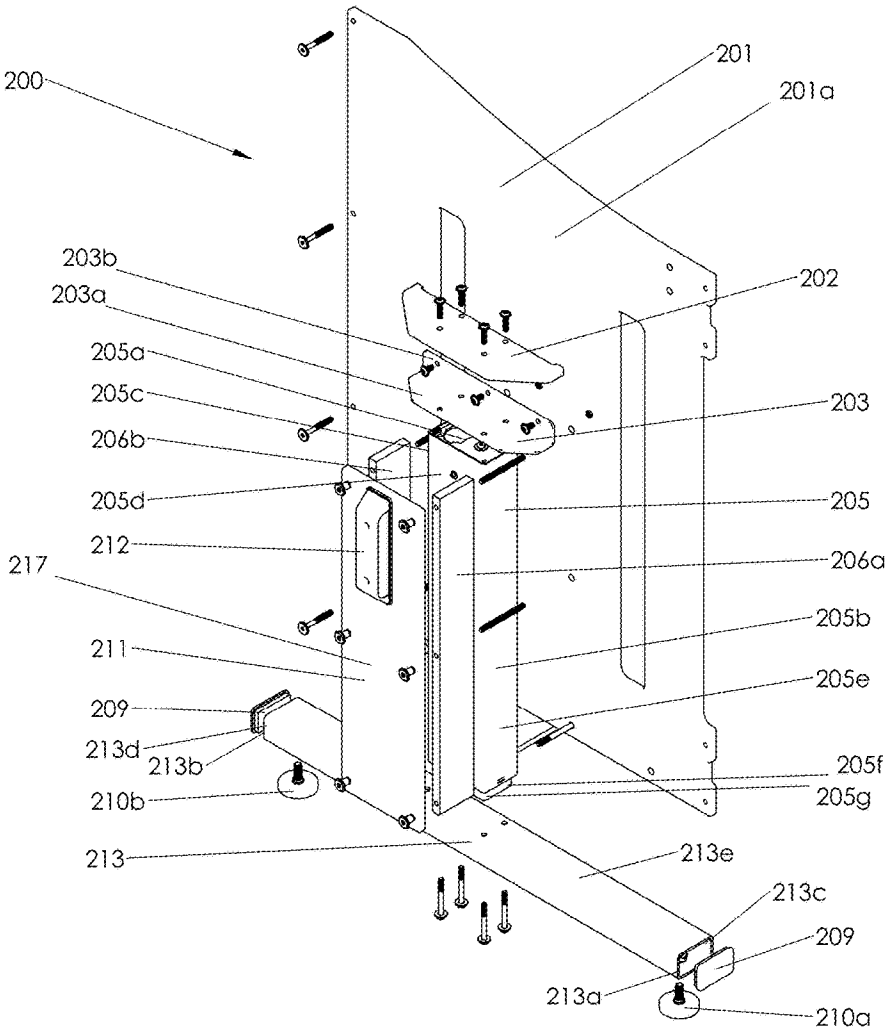
FIG. 13 is an exploded view of the left wall of a crib in accordance with an exemplary embodiment of the invention.
Figure 14:
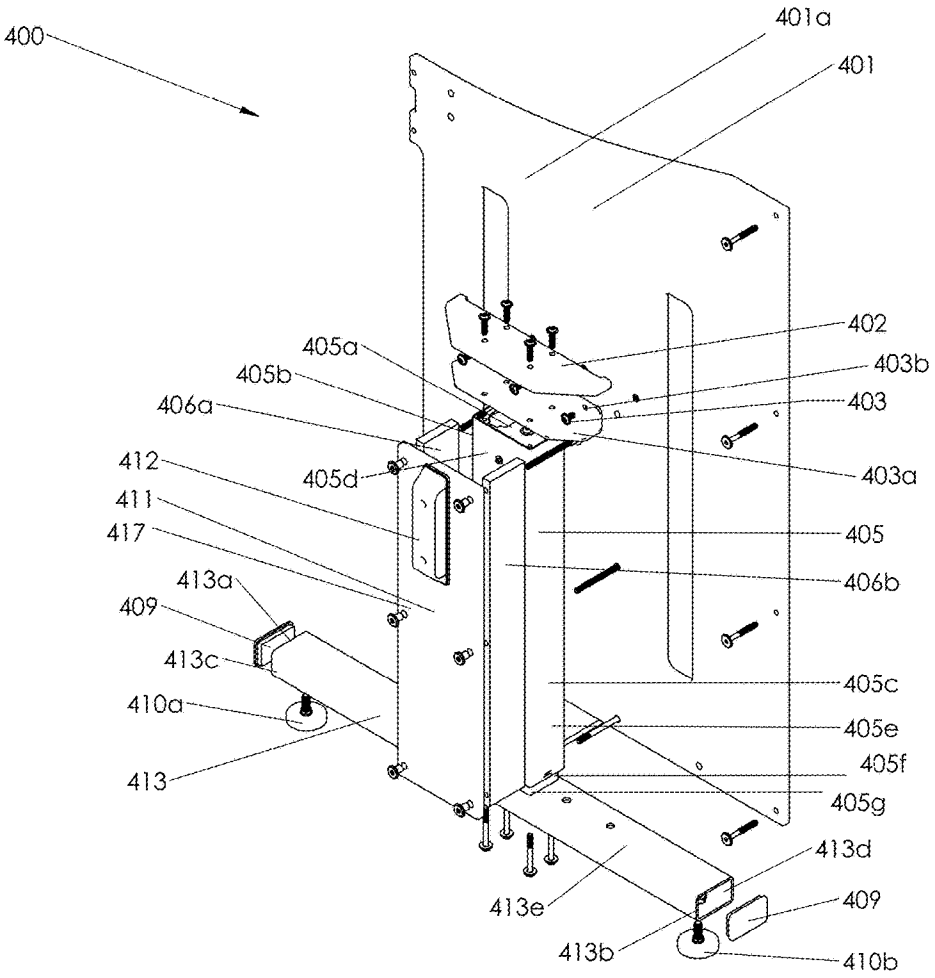
FIG. 14 is an exploded view of the right wall of a crib in accordance with an exemplary embodiment of the invention.
Figure 15:
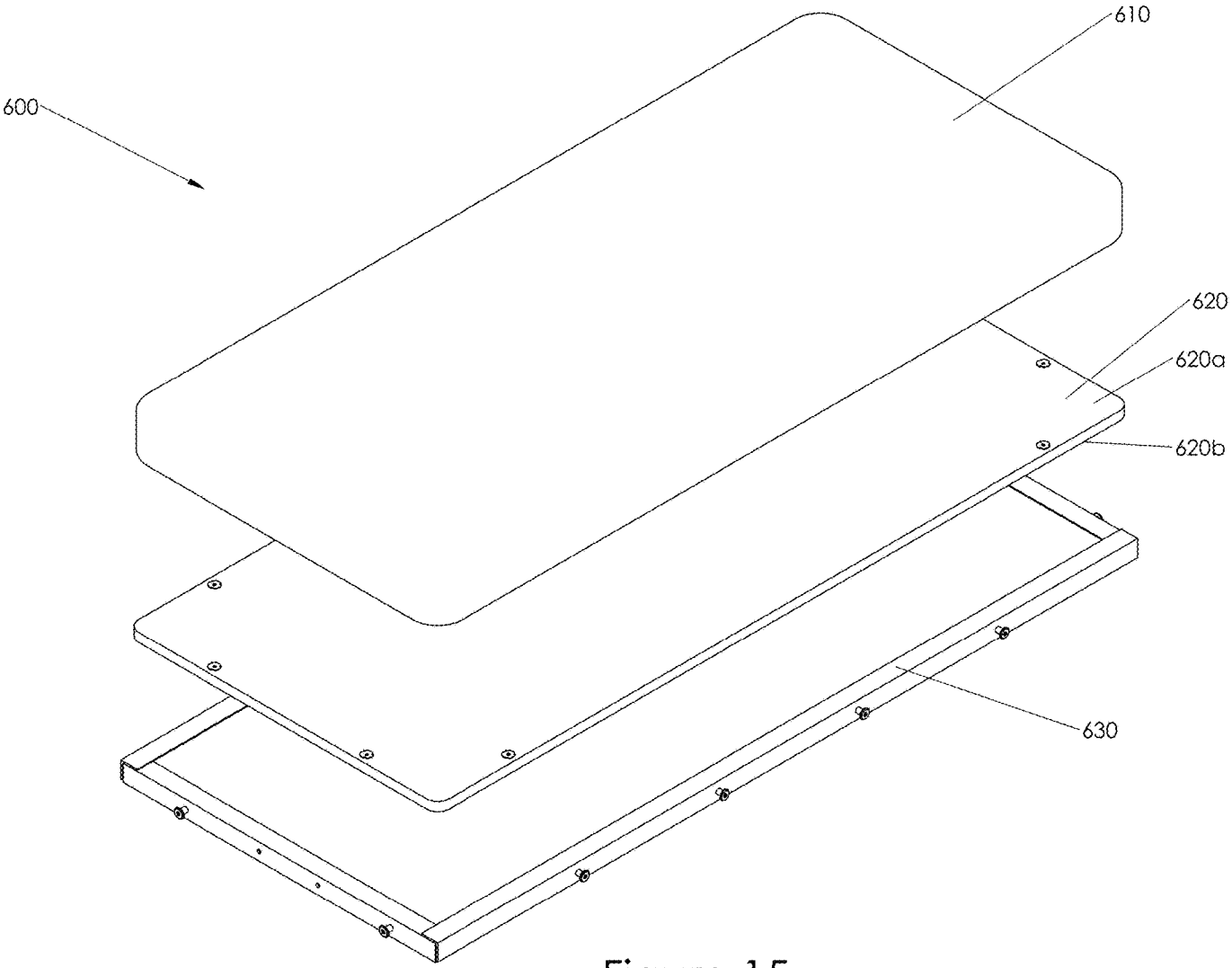
FIG. 15 is an exploded view of the mattress support of a crib in accordance with an exemplary embodiment of the invention
Figure 16:
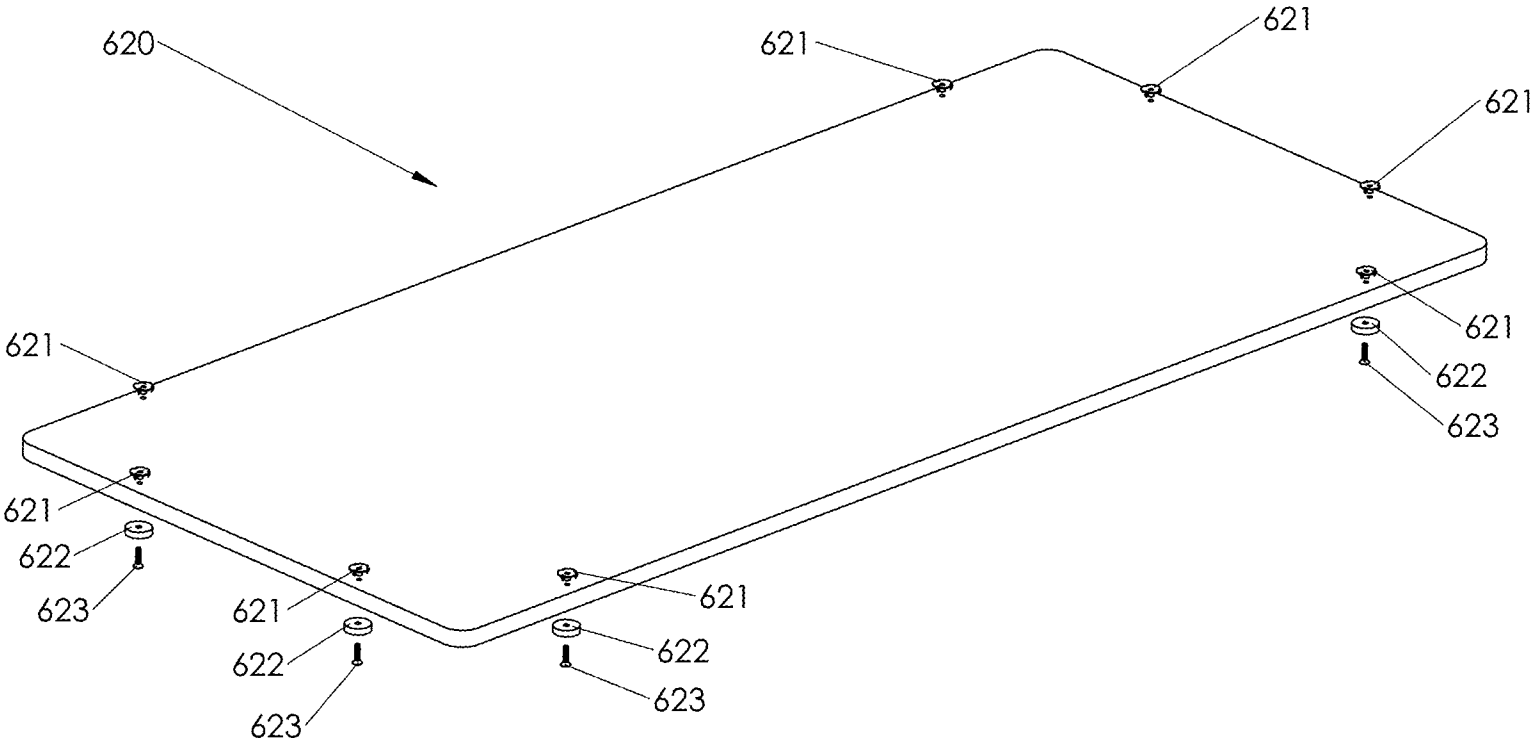
FIG. 16 is an exploded view of the mattress foundation of a crib in accordance with an exemplary embodiment of the invention.
Figure 17:
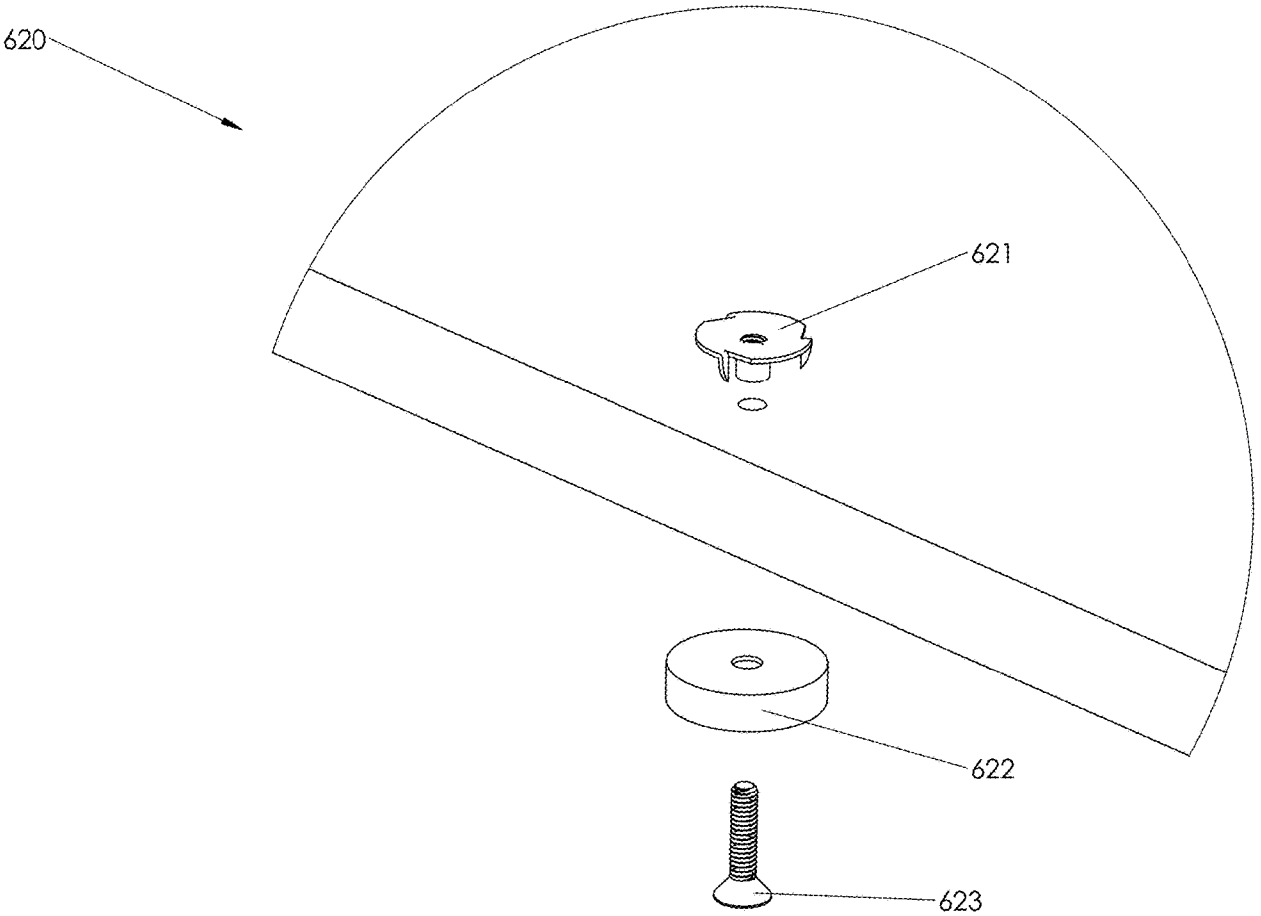
FIG. 17 is a zoomed view of the mattress foundation of a crib in accordance with an exemplary embodiment of the invention.
Figure 18A:
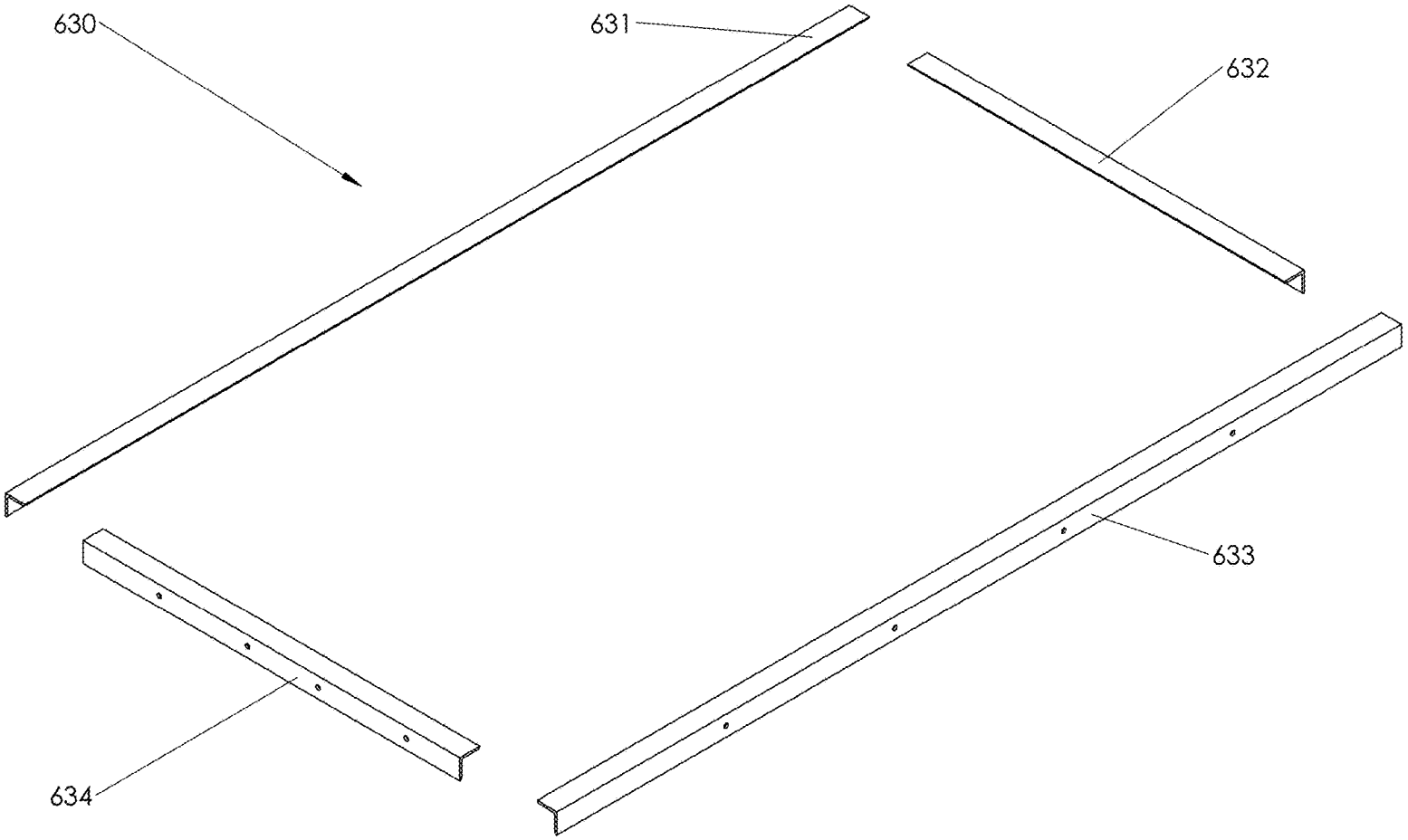
FIG. 18A is an exploded view of the mattress frame of a crib in accordance with an exemplary embodiment of the invention.
Figure 18B:
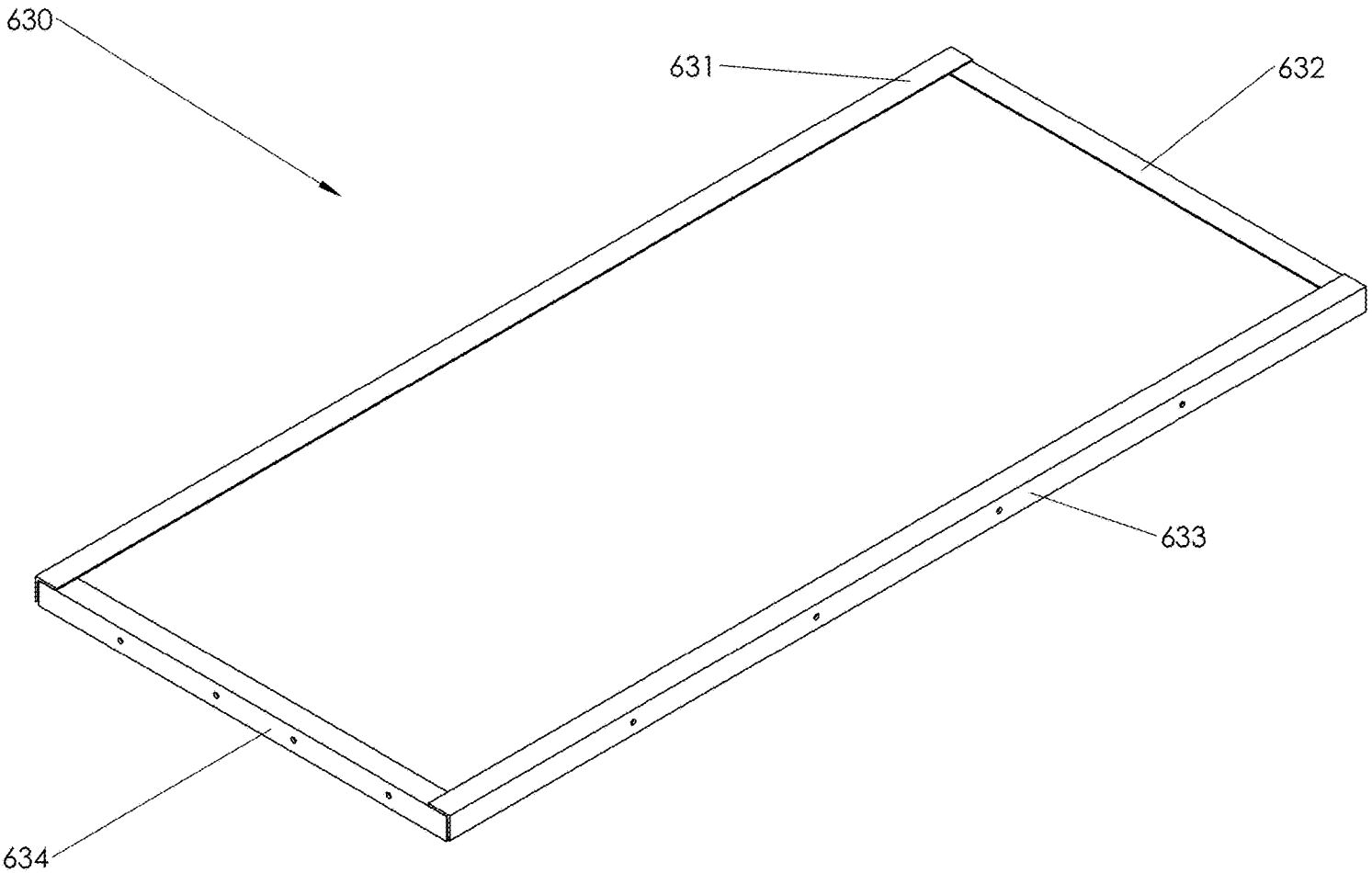
FIG. 18B is a perspective view of the mattress frame of a crib in accordance with an exemplary embodiment of the invention.
Figure 19:
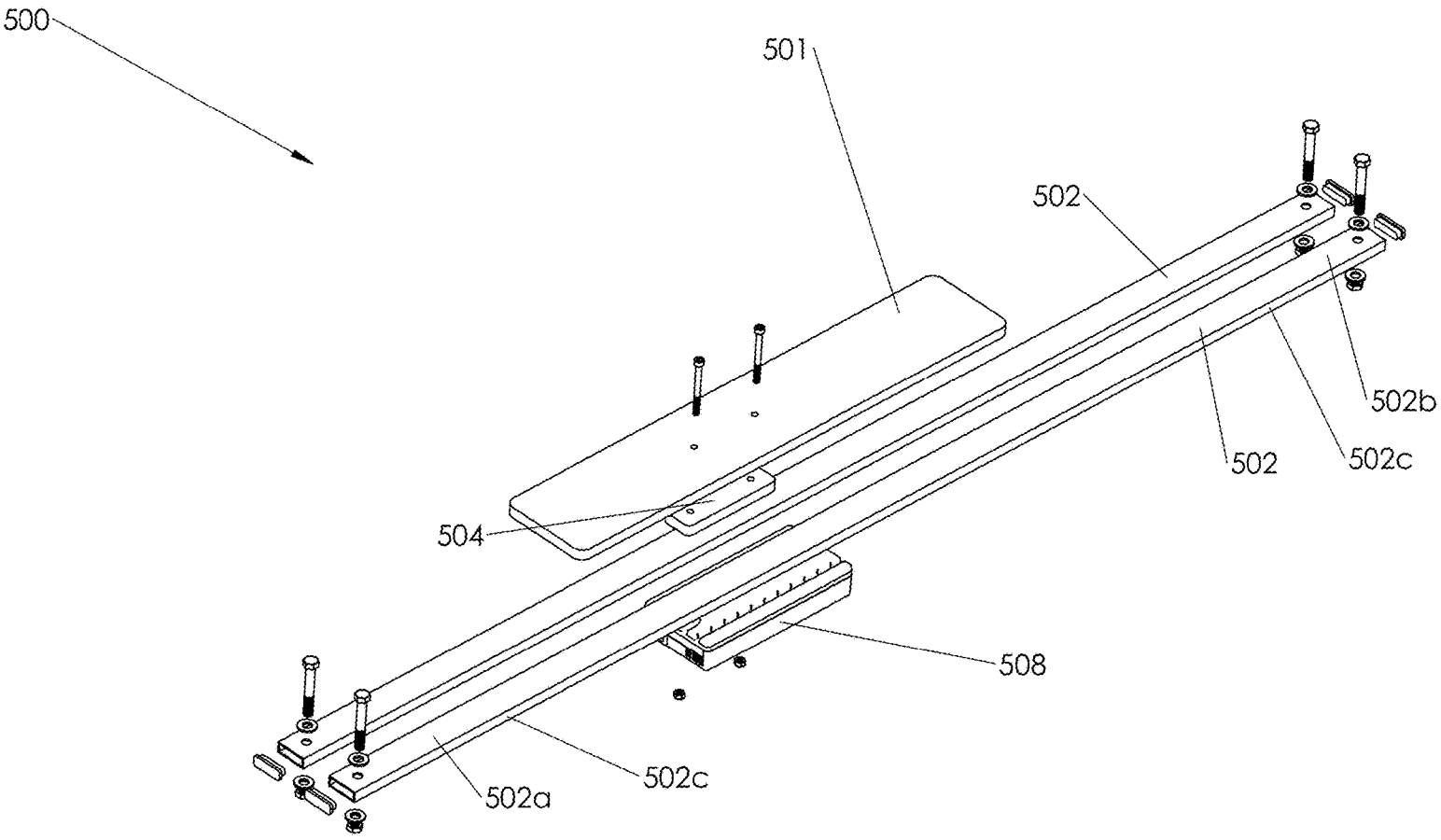
FIG. 19 is an exploded view of the horizontal bar assembly in accordance with an exemplary embodiment of the invention.
Figure 20:
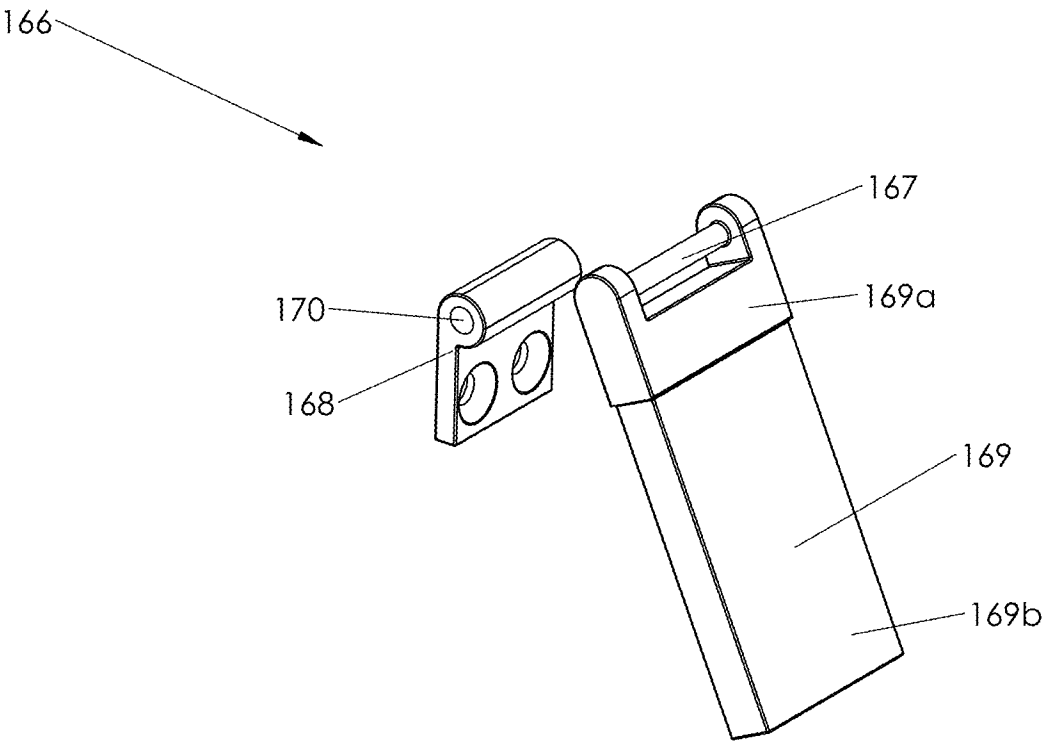
FIG. 20 zoomed view of a secondary latch in the locked position in accordance with an exemplary embodiment of the invention.

Turning to FIGS. 13-14, the left wall panel 201 and right wall panel 401 of crib 1 are shown. In an exemplary embodiment, left wall panel 201 and right wall panel 401 can be machined from a solid surface plastic polymer. The left wall panel 201 and right wall panel 401 can have a plurality of vertical sidewall slots. In an exemplary embodiment, the vertical sidewall slots of the left wall panel 201 and right wall panel 401 can be about are 2" wide and have edges that feature a soft touch round-over. Each side panel has a lifting column to support the lifting of the carriage 10. The left lifting column 205 is attached to left wall panel 201 of left wall 200 using left lifting ledge 203. In an exemplary embodiment, left lifting column 205 is located at about the horizontal center of the left wall 200. In another exemplary embodiment, left lifting column 205 is located on the left wall 200 about between the rear wall 300 and front wall 100. In another exemplary embodiment, left lifting column 205 is located on the left wall 200 about between the rear wall 300 and a horizontal center of the left wall 200. In another exemplary embodiment, left lifting column 205 is located on the left wall 200 about between the horizontal center of the left wall 200 and front wall 100.

Left lifting ledge 203 has a column surface 203*a* and a wall surface 203*b*. Column surface 203*a* and wall surface 203*b* are planar and perpendicular. Column surface 203*a* is fastened to the top 205*a* of column 205. Wall surface 203*b* of left lifting ledge 203 is fastened to the outer face 201*a* of left wall panel 201. Left lifting ledge 203 can be made of formed steel. Further, a left side column support 217 surrounds the front side 205*b*, backside 205*c* and outer face 205*d* of lifting column 205. In an embodiment, a cap 202 can be placed on top of the left lifting ledge 203. The cap 202 can be fastened to the top 205*a* of column 205 with a fastener that passes through column surface 203*a* of left lifting ledge 203 into column 205. This sandwiches and secures lifting ledge 203 between cap 202 and column 205, thereby fastening left lifting ledge 203 to the top 205*a* of column 205.

In another embodiment, a left side column support 217 surrounds the front side 205*b*, backside 205*c* and outer face 205*d* of the upper section 205*e* of lifting column 205. The left lifting column 205 can be additionally clamped to the outer face 201*a* of left wall panel 201 using left side column support 217, which secures the lifting column 205 firmly against the outer face 201*a* of left wall panel 201. This design of the left side column support 217 provides positive entrapment and clamping force for the full length of the upper section 205*e* of left lifting column 205. This entrapment design is intended to reduce any bending moment applied to the lifting ledge 203, such as when the carriage 10 of the crib 1 is in the elevated position and is rocked left to right, such as by the occupant or user. In an exemplary embodiment, upper section 205*e* is stationary. In an exemplary embodiment, the rigidity of carriage 10 and entrapment of upper section 205*e* help to ensure that the lifting force used to elevate the carriage 10 is evenly distributed through the carriage 10.

In an exemplary embodiment, left side column support 217 includes cover plate 211, front plate 206*a*, and rear plate 206*b*. Cover plate 211 can be secured to left wall panel 201 using fasteners passing through front plate 206*a* and rear plate 206*b*, which thereby also secures front plate 206*a* and rear plate 206*b* to the left wall panel 201. Cover plate 211 of left side column support 217 is located adjacent to the outer face 206*d* of the left lifting column 205, front plate 206*a* of the left side column support 217 is located adjacent to the front side 205*b* of the left lifting column 205, rear plate 206*b* of the left side column support 217 is located adjacent to the backside 205*c* of the left lifting column 205. through In an exemplary embodiment, front plate 206*a* and rear plate 206*b* are oriented perpendicular to cover plate 211 and located on opposite edges of cover plate 211, such that front plate 206*a* rear plate 206*b* and cover plate 211 of left side column support 217 forms a channel that can be placed over the upper section 205*e* of left lifting column 205. In an embodiment, the left side column support 217 runs from the left lifting ledge 203 to the bottom 205*g* of the rectangular left lifting column upper section 205*e*.

Left side lifting column 205 is rectangular and telescoping. Left side lifting column 205 includes an embedded linear actuator 205*f* that raises and lowers left lifting column upper section 205*e* vertically. The bottom 205*g* of linear actuator 205*f* of left side lifting column 205 is fastened to foot 213. In an embodiment, foot 213 is attached to left side lifting column 205 using high strength grade 8 fasteners 216. The bottom of foot 213 has a front leveling glide 210*a* at a front 213*a* of foot 213 and a rear leveling glide 210*b* at a rear 213*b* of foot 213. The front leveling glide 210*a* and rear leveling glide 210*b* allow for level adjustment of foot 213. In an embodiment, foot 213 is a rectangular channel having a front cavity 213*c* and a rear cavity 213*d*, in which plugs 209 can be inserted.

As was previously stated, each side panel has a lifting column to support the lifting of the carriage 10. The right lifting column 405 is attached to right wall panel 401 of right wall 400 using right lifting ledge 403. In an exemplary embodiment, right lifting column 405 is located at about the horizontal center of the right wall 400. In another exemplary embodiment, right lifting column 405 is located on the right wall 400 about between the rear wall 300 and front wall 100. In another exemplary embodiment, right lifting column 405 is located on the right wall 400 about between the rear wall 300 and a horizontal center of the right wall 400. In another exemplary embodiment, right lifting column 405 is located on the right wall 400 about between the horizontal center of the right wall 400 and front wall 100.

Right lifting ledge 403 has a column surface 403*a* and a wall surface 403*b*. Column surface 403*a* and wall surface 403*b* are planar and perpendicular. Column surface 403*a* is fastened to the top 405*a* of column 405. Wall surface 403*b* of right lifting ledge 403 is fastened to the outer face 401*a* of right wall panel 401. Right lifting ledge 403 can be made of formed steel. Further, a right side column support 417 surrounds the front side 405*b*, backside 405*c* and outer face 405*d* of lifting column 405. In an embodiment, a cap 402 can be placed on top of the right lifting ledge 403. The cap 402 can be fastened to the top 405*a* of column 405 with a fastener that passes through column surface 403*a* of right lifting ledge 403 into column 405. This sandwiches and secures lifting ledge 403 between cap 402 and column 405, thereby fastening right lifting ledge 403 to the top 405*a* of column 405.

In another embodiment, a right side column support 417 surrounds the front side 405*b*, backside 405*c* and outer face 405*d* of the upper section 405*e* of lifting column 405. The right lifting column 405 can be additionally clamped to the outer face 401*a* of right wall panel 401 using right side column support 417, which secures the lifting column 405 firmly against the outer face 401*a* of right wall panel 401. This design of the right side column support 417 provides positive entrapment and clamping force for the full length of the upper section 405*e* of right lifting column 405. This entrapment design is intended to reduce any bending moment applied to the lifting ledge 403 which is the case when the carriage 10 of crib 1 is in the elevated position and is rocked left to right, such as by the occupant or user. In an exemplary embodiment, upper section 405*e* is stationary. In an exemplary embodiment, the rigidity of carriage 10 and entrapment of upper section 405*e* help to ensure that the lifting force used to elevate the carriage 10 is evenly distributed through the carriage 10.

In an exemplary embodiment, right side column support 417 includes cover plate 411, front plate 406*a*, and rear plate 406*b*. Cover plate 411 can be secured to right wall panel 401 using fasteners passing through front plate 406*a* and rear plate 406*b*, which thereby also secures front plate 406*a* and rear plate 406*b* to the right wall panel 401. Cover plate 411 of right side column support 417 is located adjacent to the outer face 406*d* of the right lifting column 405, front plate 406*a* of the right side column support 417 is located adjacent to the front side 405*b* of the right lifting column 405, rear plate 406*b* of the right side column support 417 is located adjacent to the backside 405*c* of the right lifting column 405.

through In an exemplary embodiment, front plate 406*a* and rear plate 406*b* are oriented perpendicular to cover plate 411 and located on opposite edges of cover plate 411, such that front plate 406*a* rear plate 406*b* and cover plate 411 of right side column support 417 forms a channel that can be placed over the upper section 405*e* of right lifting column 405. In an embodiment, the right side column support 417 runs from the right lifting ledge 403 to the bottom 405*g* of the rectangular right lifting column upper section 405*e*.

Right side lifting column 405 is rectangular and telescoping. Right side lifting column 405 includes an embedded linear actuator 405*f* that raises and lowers right lifting column upper section 405*e* vertically. The bottom 405*g* of linear actuator 405*f* of right side lifting column 405 is fastened to foot 413. In an embodiment, foot 413 is attached to right side lifting column 405 using high strength grade 8 fasteners 416. The bottom of foot 413 has a front leveling glide 410*a* at a front 413*a* of foot 413 and a rear leveling glide 410*b* at a rear 413*b* of foot 413. The front leveling glide 410*a* and rear leveling glide 410*b* allow for level adjustment of foot 413. In an embodiment, foot 413 is a rectangular channel having a front cavity 413*c* and a rear cavity 413*d*, in which plugs 409 can be inserted.

Movement of the carriage 10, such as to an elevated or lowered position, is initiated by the user through either a buttons on a wireless remote or buttons on the control panel 212 on left side lifting column 205 or control panel 412 on right side lifting column 405. Some exemplary embodiments of crib 1 may only have one of control panels 212 or 412. The movement command initiated by the user via wireless remote, control panel 212, and/or control panel 412 is sent to controller 508. Controller 508 then processes the movement command and instructs left side lifting column 205 and right side lifting column 405 to simultaneously move carriage 10 at the same rate in the direction indicated by the user (raising or lowering) when the user presses and holds a button on remote and/or control panel 212 or 412. Controller 508 stops the motion of carriage 10 when user releases the button on remote and/or control panel 212 or 412. Controller 508 can also have collision reversal capabilities, which continuously monitors the activity and/or load of the left side lifting column 205 and right side lifting column 405 when in motion for changes in speed or load indicative of the carriage 10 encountering an obstruction. The controller 508 momentarily reverses the direction of and stops the movement of the left side lifting column 205 and right side lifting column 405, when the controller 508 detects that the carriage 10 has encountered an obstruction.

In an exemplary embodiment, controller 508 can be mounted underneath the horizontal bar assembly 500 using fasteners. A cover plate 501 may be placed over controller 508 and a spacer 504 may be placed between the controller 508 and cover plate 501. The spacer 504, may be placed between the bars 502 of the horizontal bar assembly 500.

Turning to FIGS. 15-18B, crib 1 has a mattress support 600, which includes mattress foundation 620, mattress frame 630, and mattress 610. The mattress 610 rests horizontally on the mattress foundation 620 and fits tightly into the inside of the carriage 10 so that no gap is observed between the mattress 610 and any of the adjacent walls, such as the front wall 100, left wall 200, rear wall 300, and right wall 400.

The mattress frame 630 has a front side 633, rear side 631, left side 634, and right side 632. The front side 633 and rear side 631 are equal in length, and the right side 632 and left side 634 are equal in length. The front side 633 and rear side 631 are longer than the right side 632 and left side 634. In an exemplary embodiment, the front side 633, rear side 631, left side 634, and right side 632 are formed of 1¼" angle iron and welded together to form mattress frame 630.

The mattress frame 630 supports the mattress 610 and also serves to strengthen and enhance the rigidity of the carriage 10 of crib 1. More specifically, the front side 633 of the mattress frame 630 is fastened to the lower door slide support member 141 of the lower door slide 140 of front wall 100. Further, the rear side 631 of the mattress frame 630 is fastened to a lower portion 301*c* the rear wall panel 301 of rear wall 300. Additionally, the left side 634 of the mattress frame 630 is fastened to a lower portion 201*e* of the left wall panel 201 of left wall 200. Further, the right side 632 of the mattress frame 630 is fastened to a lower portion 401*e* of the right wall panel 401 of the right wall 400.

Further, the rear face 141*b* of lower door slide support member 141 lower door slide 140 is fastened to the mattress frame 630 to further support and strengthen the assembly to withstand stress induced when the child or care taker leans into sleeping area 11 and on the lower door slide 140.

The mattress foundation 620 rests upon a ferrous mattress frame 630. A mattress 610 sits upon the topside 620*a* of the mattress foundation 620. The mattress foundation 620 has an underside 620*b* located opposite the topside 620*a*. The mattress foundation 620 is held in place using, a plurality of high pull force rare earth magnets 622. The magnets 622 are attached to the mattress foundation 620. In an exemplary embodiment, magnets 622 are attached around a perimeter of the mattress foundation 620 using screws 623 and insert nuts 621. In an exemplary embodiment, two magnets 622 are placed on each side of the mattress foundation 630, such that two magnets couple with each of the front side 633, rear side 631, left side 634, and right side 632 of the mattress frame 630. In an exemplary embodiment two magnets 622 are placed near each corner on each edge of the mattress foundation 620.

The selective magnetic attachment of the mattress foundation 620 to the mattress frame 630 allows the mattress foundation 620 to break away when an upward force exceeding a predetermined value is applied to an underside 620*b* of the mattress foundation 620. In an exemplary embodiment, the predetermined value can be about 30 lbf. The ability for the mattress foundation 620 to decouple from the mattress frame 630 can potentially reduce the level of injury caused by the carriage 10 lowering onto a person who is inadvertently positioned underneath the carriage 10 and experiencing crushing forces. In this event, when the upward force applied to the underside 620*b* of the mattress foundation 620 exceeds the predetermined value, the magnetic coupling force of magnets 622 is exceeded, and the magnets 622 of mattress foundation 620 detach (decouple) from mattress frame 630, thereby permitting mattress foundation 620 to float and reduce the crushing forces that would otherwise be applied if mattress foundation 620 and mattress frame 630 did not detach, but instead remained coupled together as a rigid structure.

Turning back to FIGS. 1-5B, 13-14, and 19, when either or both of the left sliding door 160 and right sliding door 180 of crib 1 are in the open position, and the carriage 10 is in an elevated position (underside 144*a* of carriage 10 is higher than the lap of the wheelchair user), the wheelchair using caregiver can roll their wheelchair between the left foot 215 and right foot 415 of crib 1 and into an underneath portion 700 of the crib 1, without encountering an obstruction. The unobstructed access to the underneath portion 700 of the crib 1 permits the caregiver user to have maximum reach range into the sleeping area 11 of the crib 1. The left lifting column 205 and the right lifting column 405 can be spaced apart a first width to accomodate a width of a wheelchair. Further, the left foot 213 and the right foot 413 can be spaced apart a second width to accomodate the width of the wheelchair. In one exemplary embodiment, the first width between the left lifting column 205 and the right lifting column 405 is equal to the second width between the left foot 213 and the right foot 413. In another embodiment, the first width between the left lifting column 205 and the right lifting column 405 is not equal to the second width between the left foot 213 and the right foot 413.

The depth 700*d* of the underneath portion 700 of the crib 1 extends from the front 213*a* of left foot 213 to the front face 502*c* of bar 502 in one exemplary embodiment, or from the front 413*a* of right foot 413 to the front face 502*c* of bar 502 in another exemplary embodiment. The width 700*w* of the underneath portion 700 of the crib 1 extends from an inner surface 214 of the left lift column 205 to an inner surface 414 of right lift column 405 in an exemplary embodiment. The height 700*h* of the underneath portion 700 of the crib 1 extends from the underside 144*a* of carriage 10 to a bottom of one of the left front leveling glide 210*a*, left rear leveling glide 210*b*, right front leveling glide 410*a*, or right rear leveling glide 410*b*. In an exemplary embodiment, the height 700*h* of the underneath portion 700 of the crib 1 extends from the underside of carriage 144*a* to a bottom of front leveling glide 210*a*. In another exemplary embodiment, the height 700*h* of the underneath portion 700 of the crib 1 extends from the underside of carriage 144*a* to the bottom of left rear leveling glide 210*b*. In an additional exemplary embodiment, the height 700*h* of the underneath portion 700 of the crib 1 extends from the underside of carriage 144*a* to the bottom of right front leveling glide 410*a*. In a further exemplary embodiment, the height 700*h* of the underneath portion 700 of the crib 1 extends from the underside of carriage 144*a* to the bottom of right rear leveling glide 410*b*.

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention. Combinations of the above embodiments and other embodiments will be apparent to those of skill in the art upon studying the above description and are intended to be embraced therein. Therefore, the scope of the present invention is defined by the appended claims, and all devices, processes, and methods that come within the meaning of the claims, either literally or by equivalence, are intended to be embraced therein.

The invention claimed is:

1. A crib comprising:

a carriage and a base having a two column lifting system;

said carriage is comprised of a rear wall, a left wall, a right wall, and a front wall extending from a mattress support, thereby forming a rigid box structure having a sleeping area for a child;

said two column lifting system having a left lifting column extending from a left foot and a right column extending from a right foot, said left lifting column and said right lifting column are telescoping, wherein said left lifting column is fastened to said left wall and said right lifting column is fastened to said right wall, said left lifting column has a linear actuator and said right lifting column has a linear actuator;

said left lifting column and said right lifting column being spaced apart a first width to accommodate a width of a wheelchair; and said left foot and said right foot being spaced apart a second width to accommodate said width of said wheelchair;

said two column lifting system is user controlled and configured to synchronize movement of said left lifting column and said right lifting column, thereby permitting a user to raise and lower said carriage to a height desired by said user; and said front wall having a sliding door that permits said user to access said sleeping area of said carriage.

2. The crib of in claim 1, wherein the two column lifting system permits a user to raise said carriage to a desired elevated position to access said sleeping area of said carriage, and lower said carriage to a lowered position when said user is not accessing said sleeping area, wherein said left lifting column is fastened to said left wall at a horizontal center of said left wall and said right lifting column is fastened to said right wall at a horizontal center of said right wall.

3. The crib of claim 2, wherein said user can access said sleeping area of said carriage in said elevated position to attend to and/or transfer a child in said crib.

4. The crib of claim 2, wherein said two column lifting system allows said user, when seated in a wheelchair, to roll said wheelchair between said left foot and said right foot and into an underneath portion of said crib, when said sliding door is in an open position and said carriage is in an elevated position, thereby maximizing a reach range of said user into said sleeping area of said crib;

wherein a bottom of said carriage is higher than a lap of said user when said user is seated in said wheelchair and said carriage is in said elevated position.

5. The crib of claim 4, wherein said underneath portion of said crib has a depth, a width, and a height; a depth of said underneath portion extends from about a front face of a bar to a front of said left foot or a front of said right foot; a width of said underneath portion extends from about an inner surface of said left lift column to an inner surface of said right lift column; and a height of said underneath portion extends from an underside of said carriage to a bottom of a leveling glide, wherein said leveling glide can be one of a left front leveling glide, a left rear leveling glide, a right front leveling glide, or a right rear leveling glide.

6. The crib of claim 4, wherein said front wall has a upper door slide and a lower door slide, said sliding door is slidingly attached to said upper door slide and said lower door slide, said upper door slide and said lower door slide are rigid, said upper door slide and said lower door slide are fastened to said right wall and said left wall, whereby a rigidity of said carriage remains unchanged when said sliding door is in an open position or a closed position.

7. The crib of claim 6, wherein said upper door slide has a steel header, thereby helping to maintain the rigidity and a shape of said carriage.

8. The crib of claim 4, wherein said sliding door is comprised of a left sliding door and a right sliding door, wherein said right sliding door and said left sliding door meet at about a horizontal center of said front wall, when said right sliding door and said left sliding door are in a closed position, and slide outward away from a horizontal center of said front wall when transitioning from a closed position to said open position.

9. The crib of claim 8, wherein a latch for said left sliding door and said right sliding door of said front wall is located at the horizontal center of said front wall, wherein said latch is a locking latch;

wherein a co-location of said latch and said left sliding door and said right sliding door at the horizontal center of said front wall permits a user to perform the following actions with a single hand while sitting in a wheelchair: unlocking and relocking said latch and opening and closing said left sliding door and said right sliding door.

10. The crib of claim 9, wherein said latch is comprised of a primary latch and a secondary latch, wherein at least one of said primary latch or secondary latch automatically locks, when said left sliding door and/or said right sliding door are placed in said closed position.

11. The crib of claim 8, said upper door slide further comprising an upper door retaining channel and said lower door slide further comprising a lower door retaining channel, wherein said upper door retaining channel retains an upper portion of said left and right sliding doors, and said lower door retaining channel retains a lower portion of said left and right sliding doors, when a roller bearing slide of said left and right sliding doors fails and/or falls off track, thereby preventing said left and right sliding doors from dislodging from said front wall due to a failure of said roller bearing slide.

12. The crib of claim 1, said mattress support further comprising a mattress foundation laying on top of a mattress frame, said mattress frame is ferrous;

a plurality of magnets are fastened to a perimeter of said foundation, wherein said mattress foundation is magnetically selectively attachable to said mattress frame;

said mattress foundation magnetically detaches from said mattress frame, when an upward force exceeding a predetermined value is applied to an underside of the mattress foundation, wherein said predetermined value is about 30 lbf.

13. The crib of claim 1, wherein an upper section of said left lifting column is entrapped against said left wall by a left side column support, and an upper section of said right lifting column is entrapped against said right wall by a right side column support.

14. The crib of claim 13, wherein a rigidity of said carriage and an entrapment of said upper section of said left lifting column and said upper section of said right lifting column evenly distribute through said carriage a lifting force used to elevate said carriage.

15. The crib of claim 1, wherein said crib is further comprised of a controller configured to monitor said linear actuators for a collision with an obstruction while moving said carriage between an elevated position and a lowered position, and respond upon a detection of said collision.

16. The crib of claim 15, wherein said controller responds when said collision is detected by momentarily changing a direction of travel of said carriage and then stopping the travel of said carriage.

17. The crib of claim 15, wherein said carriage is raised or lower, when a button connected to said controller is pressed and held by said user; said raising or lowering of said carriage stops upon a release of said button by said user.

18. The crib of claim 17, wherein the button can be on a control panel mounted on said crib and hardwired to said controller, or said button can be on a wireless remote that is wirelessly connected to said controller.

19. The crib of claim 1, wherein a horizontal bar attached to said right foot and said left foot maintain a horizontal rigidity of the crib by reducing a rotation of said right foot and said left foot, when said carriage is in an elevated position and a lateral horizontal force is applied to said crib.

20. The crib of claim 1, wherein a panel of said crib is constructed of a solid surface plastic polymer;

wherein:

said first width between said left lifting column and said right lifting column is not equal to said second width between said left foot and said right foot, or said first width between said left lifting column and said right lifting column is equal to said second width between said left foot and said right foot.

* * * * *